US010077776B2

(12) United States Patent
Dane

(10) Patent No.: US 10,077,776 B2
(45) Date of Patent: Sep. 18, 2018

(54) SUBMERSIBLE PUMP APPARATUS

(71) Applicant: Willis Dane, Peru, IL (US)

(72) Inventor: Willis Dane, Peru, IL (US)

( * ) Notice: Subject to any disclaimer, the term of this patent is extended or adjusted under 35 U.S.C. 154(b) by 0 days.

(21) Appl. No.: 15/161,732

(22) Filed: May 23, 2016

(65) Prior Publication Data

US 2016/0265537 A1 Sep. 15, 2016

Related U.S. Application Data

(63) Continuation of application No. 13/664,272, filed on Oct. 30, 2012, now Pat. No. 9,347,449.

(51) Int. Cl.

| | |
|---|---|
| ***F04D 13/08*** | (2006.01) |
| ***F04D 29/64*** | (2006.01) |
| ***F04D 29/54*** | (2006.01) |
| ***F04D 13/06*** | (2006.01) |
| ***F04D 13/10*** | (2006.01) |
| ***F04D 29/12*** | (2006.01) |
| ***F04D 29/08*** | (2006.01) |
| ***F04D 29/18*** | (2006.01) |
| ***F04D 29/52*** | (2006.01) |

(52) U.S. Cl.

CPC ..... *F04D 13/08* (2013.01); *F04D 13/0606* (2013.01); *F04D 13/10* (2013.01); *F04D 29/086* (2013.01); *F04D 29/126* (2013.01); *F04D 29/181* (2013.01); *F04D 29/528* (2013.01); *F04D 29/548* (2013.01); *F04D 29/648* (2013.01)

(58) Field of Classification Search

CPC ..... F04D 13/06; F04D 13/08; F04D 13/10; F04D 13/606; F04D 29/426; F04D 29/126; F04D 29/648; F04D 29/181; F04D 29/528; F04D 29/548; F04D 29/08; F04D 39/106; F04D 13/0606; F04D 29/086; B63H 23/34; B63H 23/342; F16D 1/00; F16D 1/06116; F16D 2001/102; F16D 2001/103

USPC ..... 417/423.3, 423.7, 423.11, 423.14, 423.5; 415/416; 464/18, 19, 21, 69, 71, 72, 97, 464/161, 149

See application file for complete search history.

(56) References Cited

U.S. PATENT DOCUMENTS

| | | | | |
|---|---|---|---|---|
| 3,769,930 A * | 11/1973 | Pinkerton | ..... | B63H 23/04 440/58 |
| 5,690,368 A | 11/1997 | Johnson | | |
| 6,224,354 B1 | 5/2001 | Brandt | | |
| 6,287,074 B1 | 9/2001 | Chancellor | | |

(Continued)

*Primary Examiner* — Essama Omgba
*Assistant Examiner* — Christopher Brunjes
(74) *Attorney, Agent, or Firm* — Knechtel, Demeur & Samlan

(57) ABSTRACT

A submersible pump apparatus providing a motor assembly, a pump assembly, and a plastic pump housing. The motor assembly is either a canned motor assembly or a four inch motor assembly. The canned motor assembly is designed to prevent the immediate destruction of the submersible pump apparatus upon the occurrence of the breaching or leaking of the seals. The pump assembly is designed with either a single stage pump or multiple stage pump that utilizes a unique combination of propellers and intermediate flow straighteners, and driving mechanisms for the same. The plastic pump housing is designed to accommodate attachment of either the canned motor assembly or the four inch motor assembly to the same pump assembly.

10 Claims, 24 Drawing Sheets

(56) References Cited

U.S. PATENT DOCUMENTS

| | | | | |
|---|---|---|---|---|
| 8,287,235 | B2 * | 10/2012 | Orban | F04D 7/02 415/199.2 |
| 2003/0153218 | A1 * | 8/2003 | Booe | B63H 23/34 440/53 |
| 2006/0165531 | A1 * | 7/2006 | Mansson | B63H 23/34 416/244 B |
| 2006/0245945 | A1 * | 11/2006 | Wilson | F04D 19/022 417/405 |
| 2007/0201994 | A1 | 8/2007 | Itani | |
| 2009/0010773 | A1 | 1/2009 | Parmeter et al. | |
| 2010/0221105 | A1 * | 9/2010 | Markovitch | F04D 13/10 415/199.1 |
| 2011/0236233 | A1 | 9/2011 | Merill | |
| 2012/0288385 | A1 * | 11/2012 | Song | F04D 13/10 417/423.1 |

* cited by examiner

SUBMERSIBLE PUMP APPARATUS

I. CROSS-REFERENCE TO RELATED APPLICATION

This patent application is a continuation application claiming priority from U.S. patent application Ser. No. 13/664,272, entitled "Submersible Pump Apparatus," filed on Oct. 30, 2012, is fully incorporated herein by reference, and still pending.

II. FIELD OF THE INVENTION

The present invention relates to submersible pumps and, more particularly, to a new and improved submersible pump apparatus.

III. DESCRIPTION OF THE PRIOR ART

Submersible pumps have been around in the public domain for many years. A typical submersible pump is a device that has a hermetically sealed motor coupled with a pump and a discharge assembly. The entire submersible pump is submerged in a fluid such as water, oil, or other fluid depending upon the application and use, and then used to pump this fluid to the surface. Submersible pumps are used in many applications such as circulation or aeration devices commonly used for creating directional flow in a pond or lake to turn still, stagnant water into a stream environment, to pump from one water body to another or to a tank, and/or also create a fountain or other visual water displays and designs. As a result, these types of submersible pumps help, among other benefits, to add vital oxygen to the water and improve the pond or lake aeration; reduce aquatic plant growth and inhibit mosquito reproduction; and/or protect permanent fixtures in the water such as docks from ice damage.

However, considering the conditions under which these types of submersible pumps operate, submersible pumps also experience some inherent problems. For example, once installed, these submersible pumps remain and are operated completely submerged in the fluid. Although the motors contained in the submersible pump are hermetically sealed, submersible pumps are subjected to a constant presence of, and surrounded by, fluid (e.g., such as water). Upon the gradual wearing down of the mechanical seals, this presence of fluid unfortunately will breach or leak through the seals and cause the destruction of the submersible pumps. Although another submersible pump can simply replace the one just destroyed, the continued, more frequent replacement of these submersible pumps is an expense that can be avoided or delayed if the submersible pump is designed to account for the breach in the seals to prevent the immediate destruction of the submersible pump and to prevent future failure of the expensive motor.

Accordingly, Applicant's new and improved inventive submersible pump apparatus solves these and other problems. Thus, there is a need and there has never been disclosed Applicant's unique submersible pump.

IV. SUMMARY OF THE INVENTION

The present invention is a submersible pump apparatus comprising a motor assembly, a pump assembly, and a plastic pump housing. The motor assembly is either a canned motor assembly or a four inch motor assembly. The canned motor assembly is designed to prevent the immediate destruction of the submersible pump apparatus upon the occurrence of the breaching or leaking of the seals. The pump assembly is designed with either a single stage pump or multiple stage pump that utilizes a unique combination of propellers and flow straighteners, and driving mechanisms for the same. The plastic pump housing is designed to accommodate attachment of either the canned motor assembly or the four inch motor assembly to the same pump assembly.

V. BRIEF DESCRIPTION OF THE DRAWINGS

The Description of the Preferred Embodiment will be better understood with reference to the following figures.

Figure 5A:
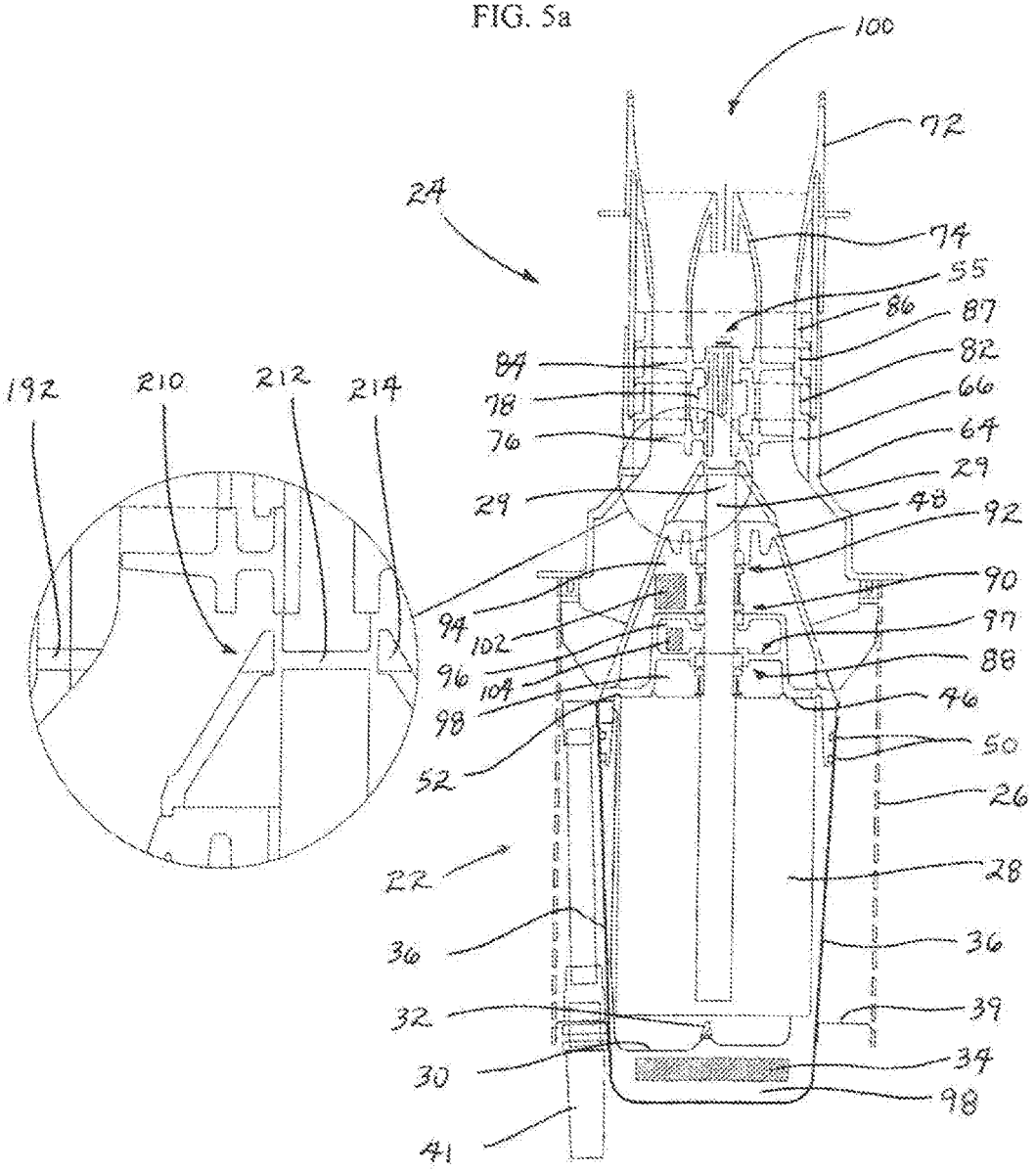

FIG. 5*a* is a cross-sectional view of the submersible pump apparatus illustrating, in particular, the canned motor assembly and the pump assembly.

Figure 5B:
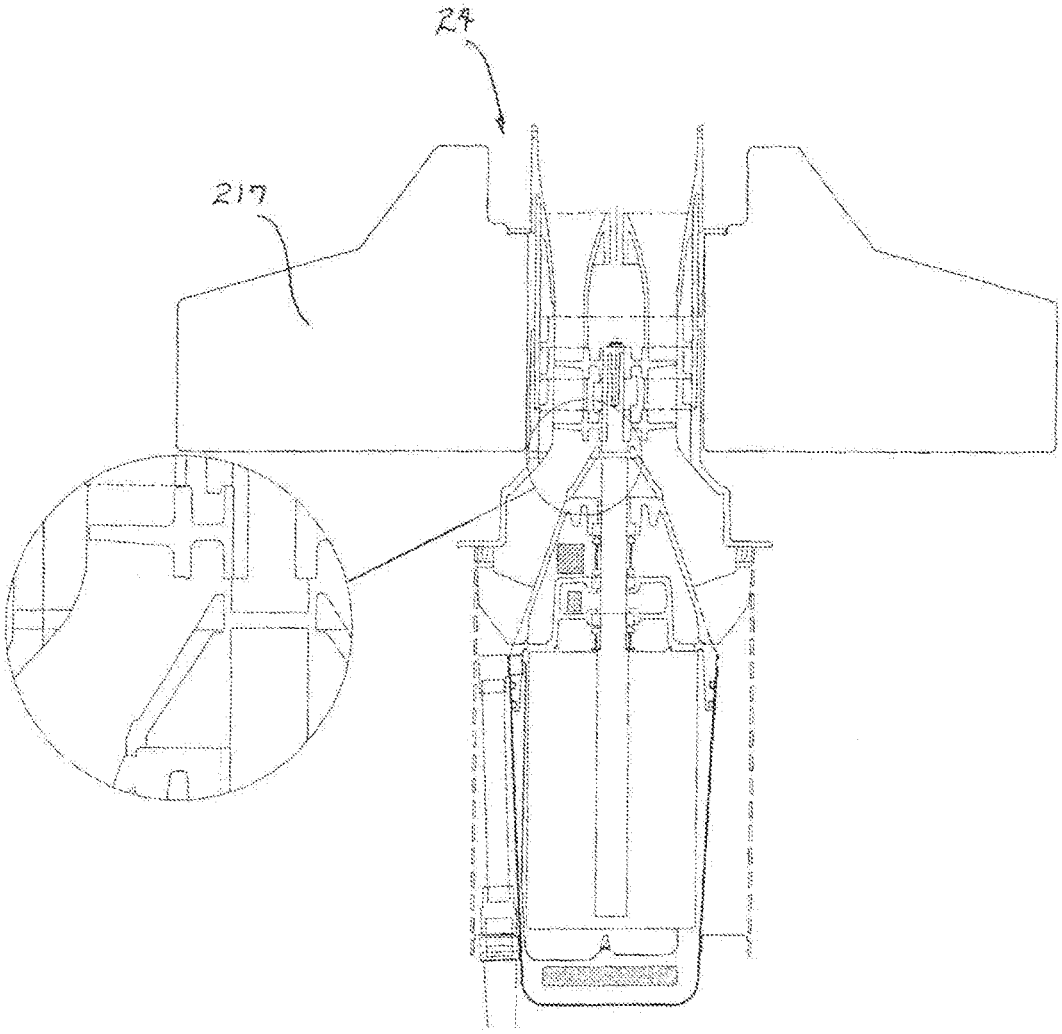

FIG. 5*b* is a cross-sectional view of the submersible pump apparatus illustrating, in particular, the canned motor assembly and the pump assembly as attached to a float for use as a floatation fountain.

Figure 6:
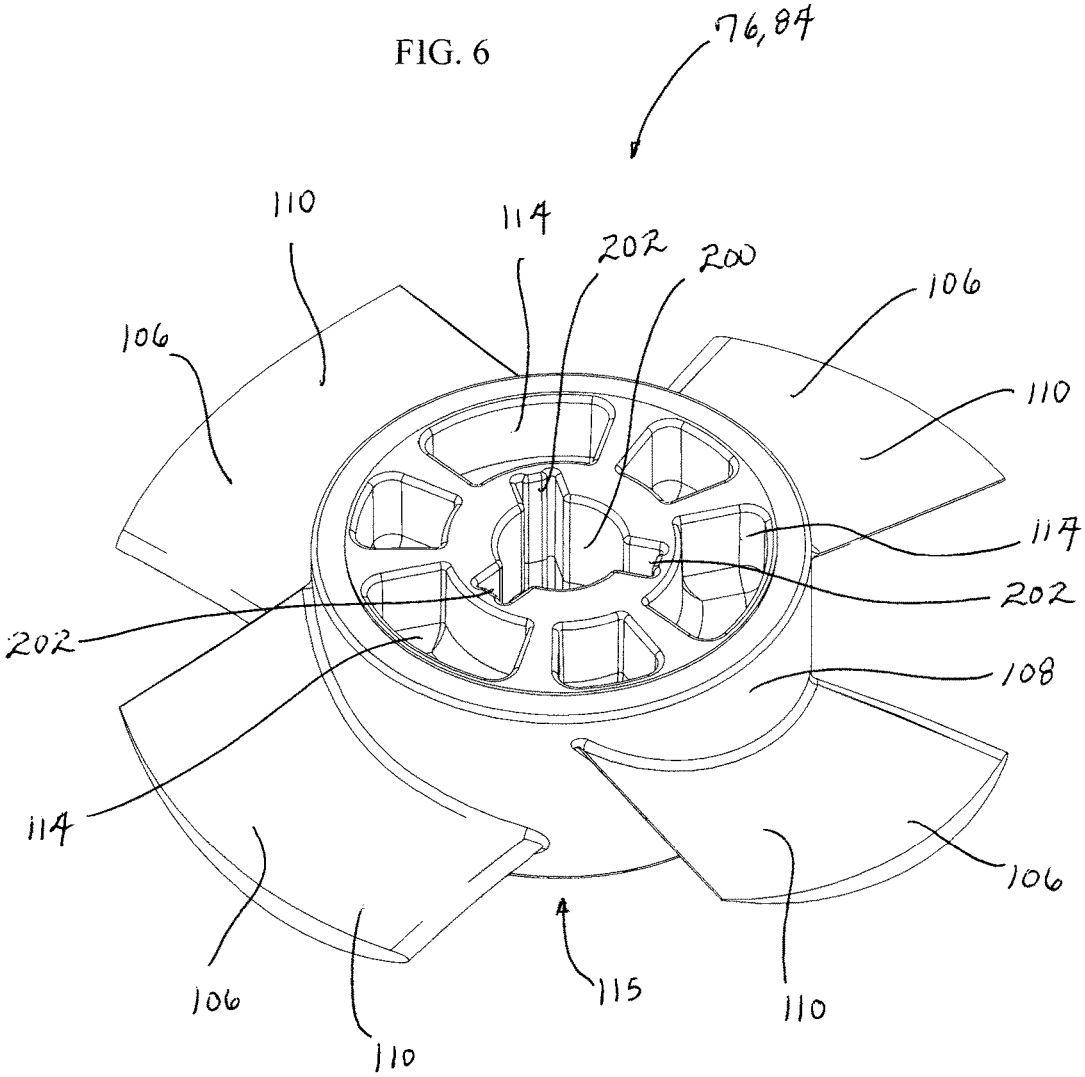

FIG. 6 is a side perspective view of the propeller for the pump assembly.

Figure 7:
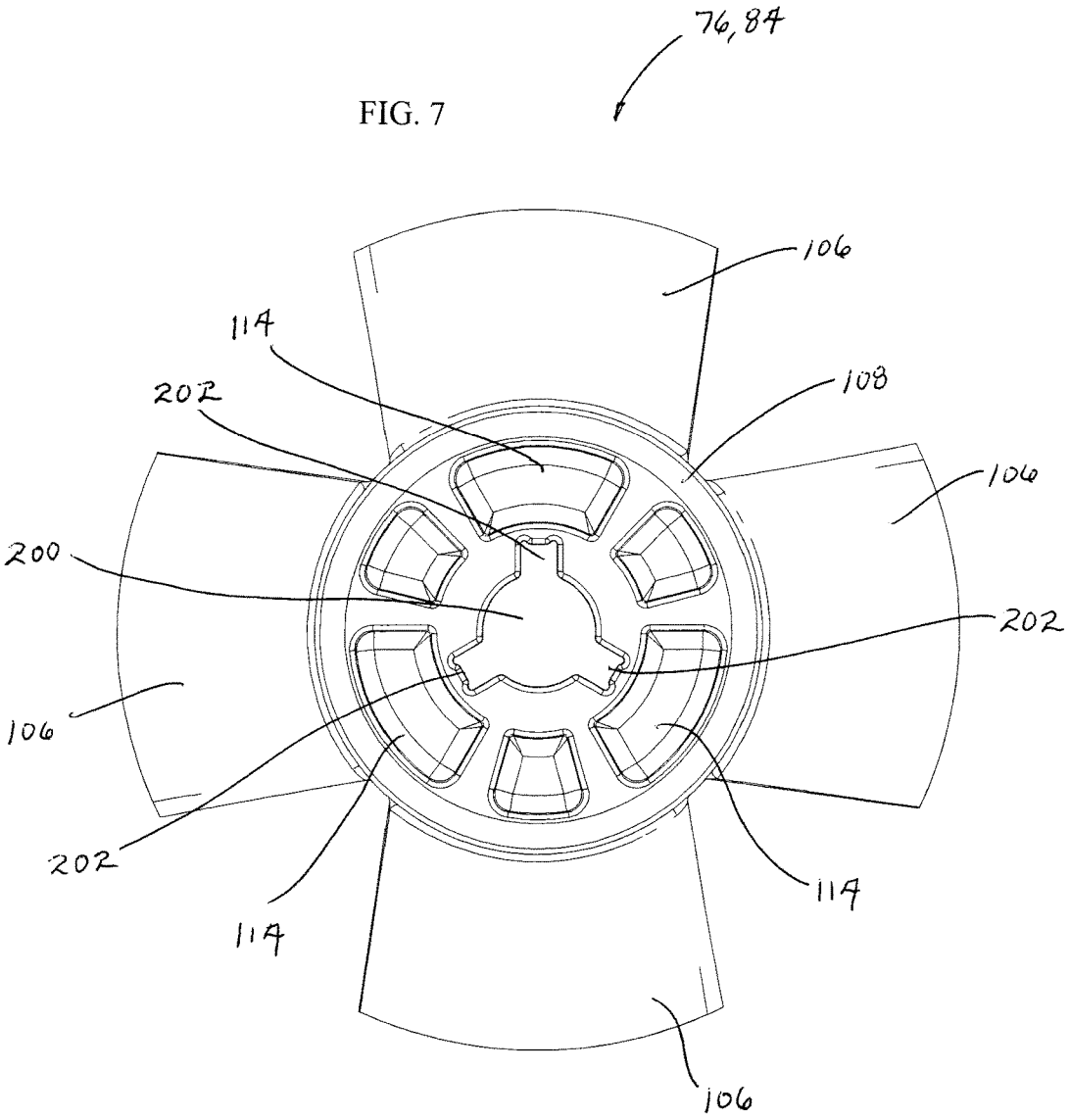

FIG. 7 is a top view of the propeller for the pump assembly.

Figure 8:
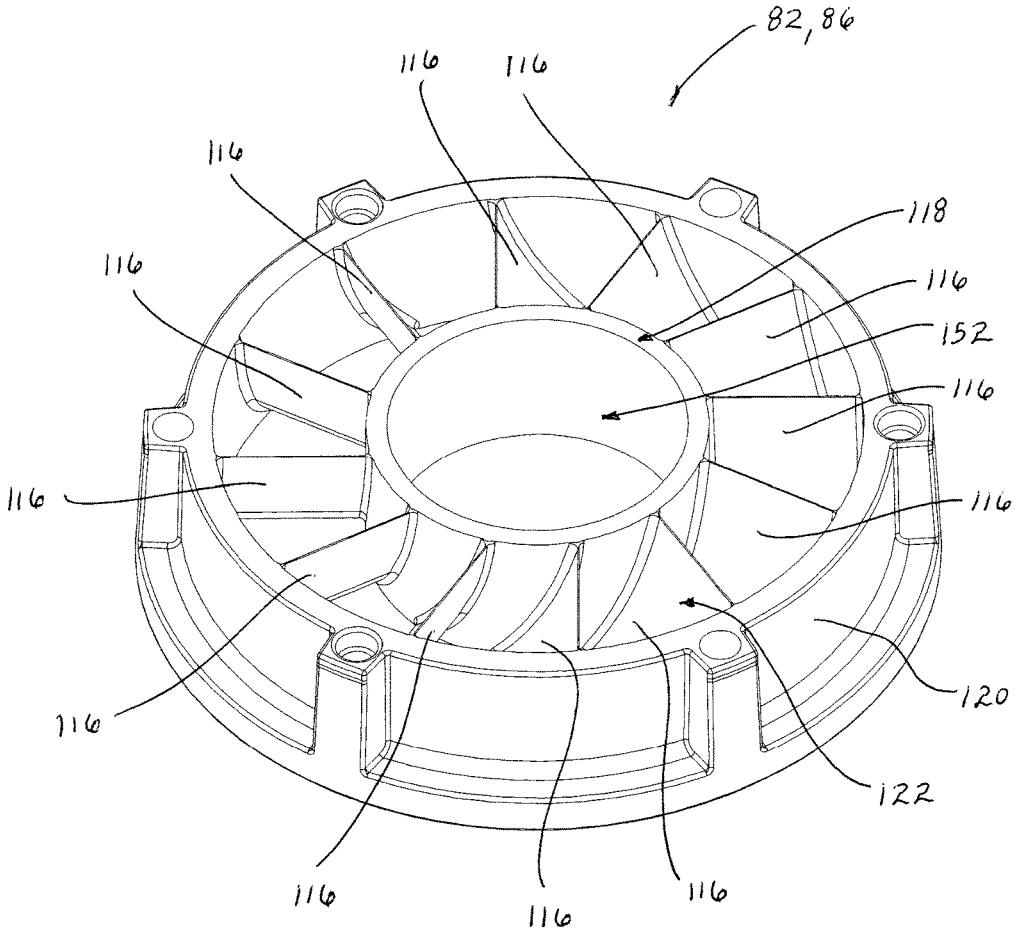

FIG. 8 is a side perspective view of the intermediate flow straightener for the pump assembly.

Figure 9:
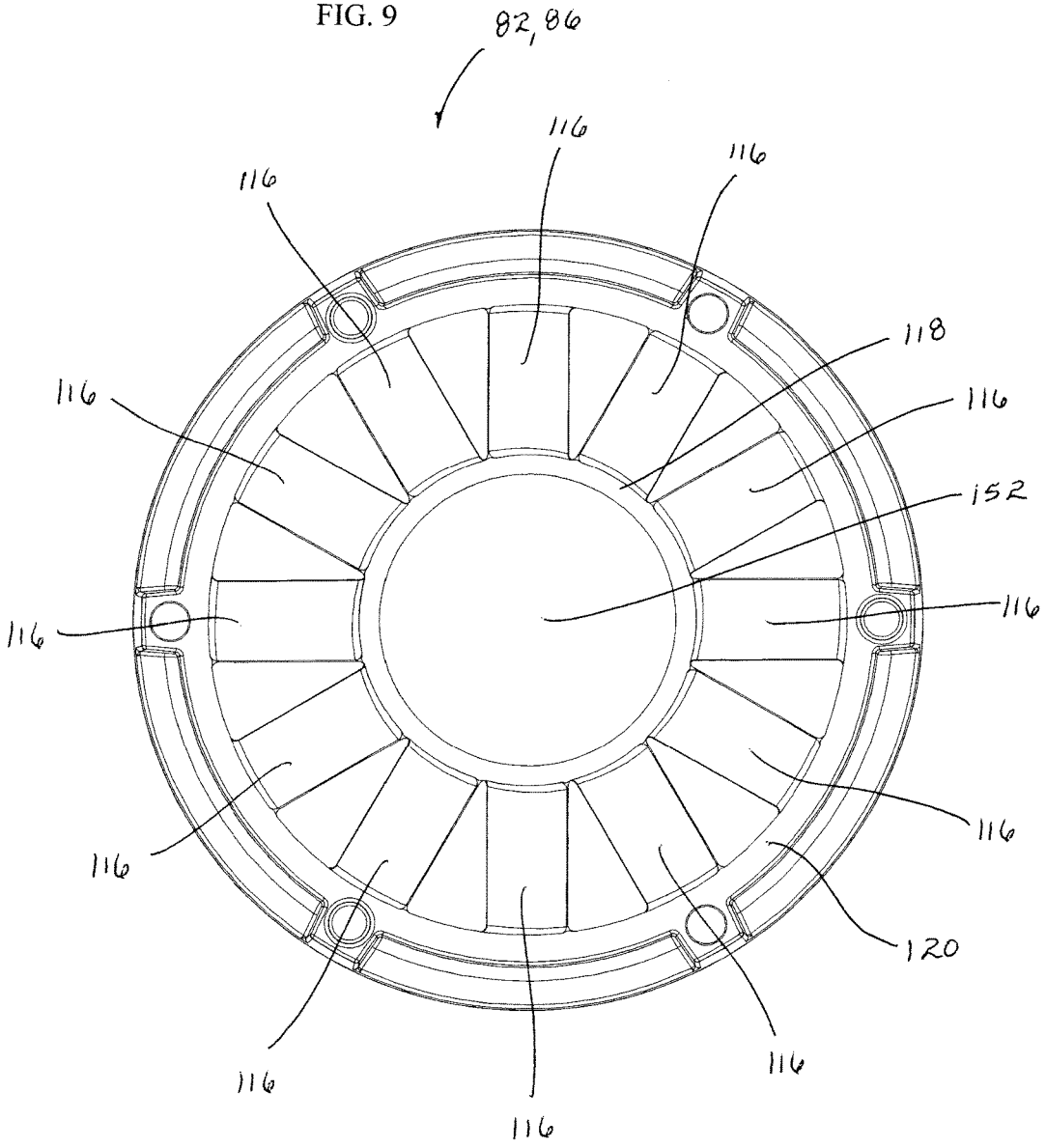

FIG. 9 is a top view of the intermediate flow straightener for the pump assembly.

Figure 10:
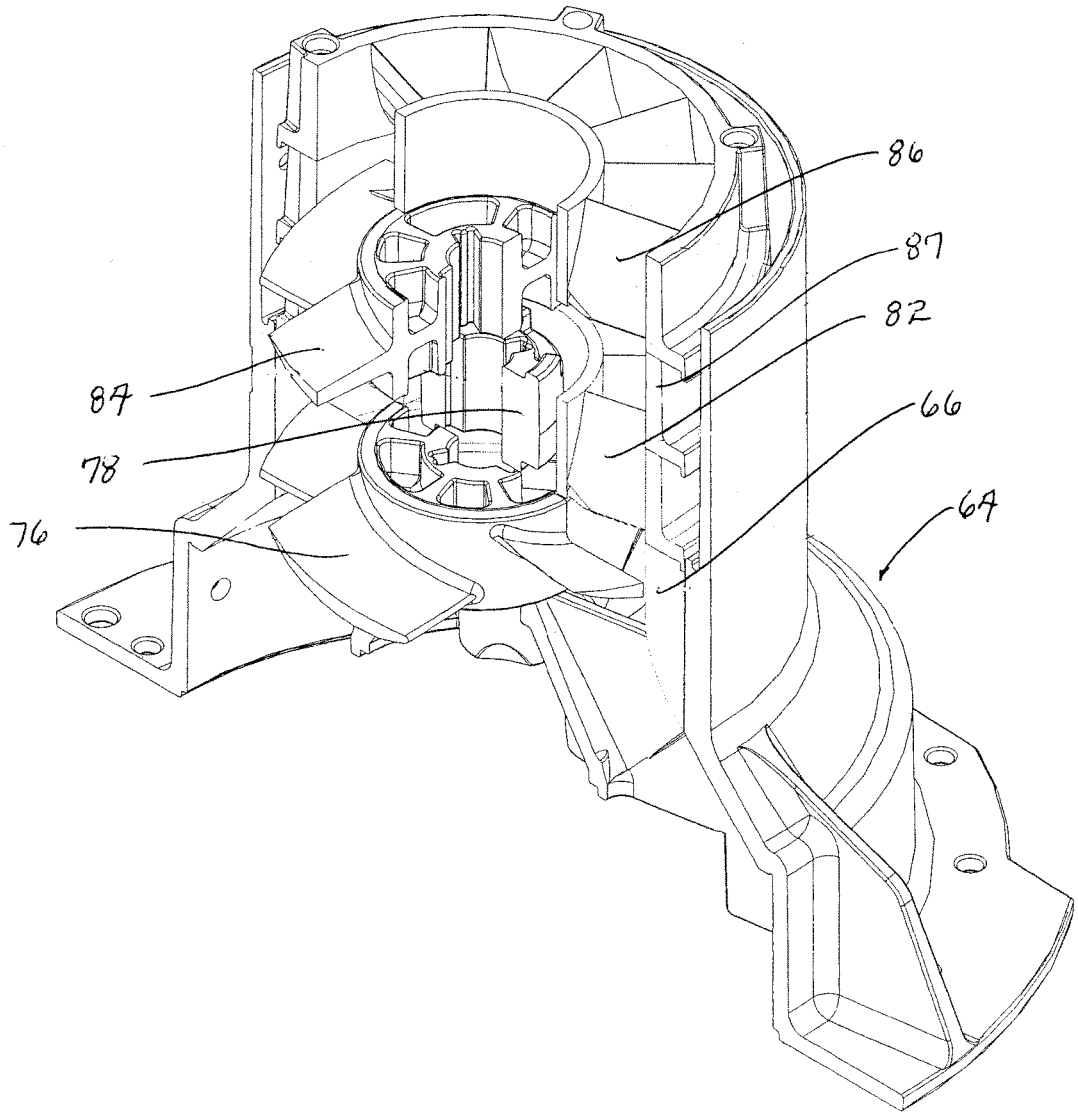

FIG. 10 is a cross-sectional view, with portions removed, of the double stage pump of the pump assembly.

Figure 11:
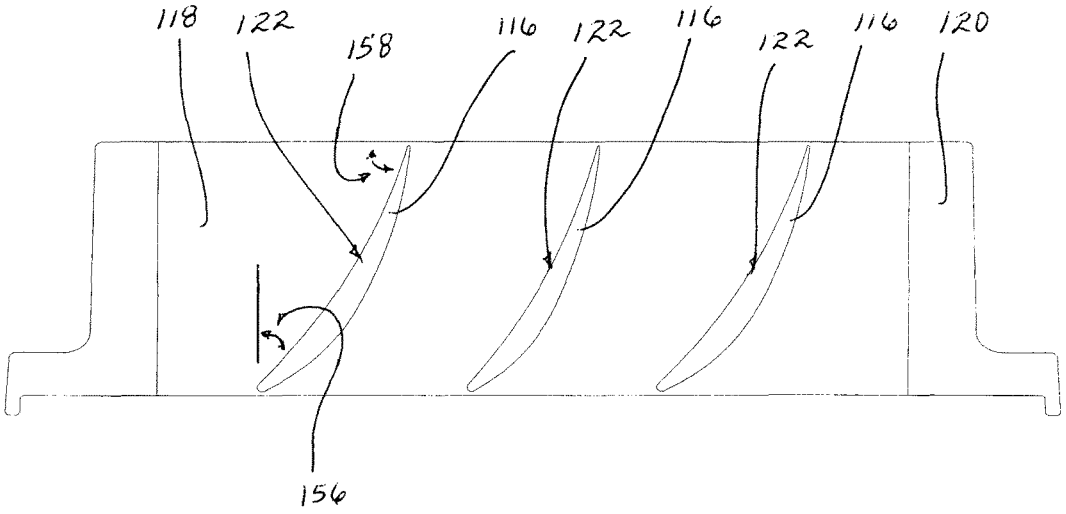

FIG. 11 is a partial cross sectional view, with portions removed, of the vanes in the intermediate flow straightener for the pump assembly.

Figure 12:
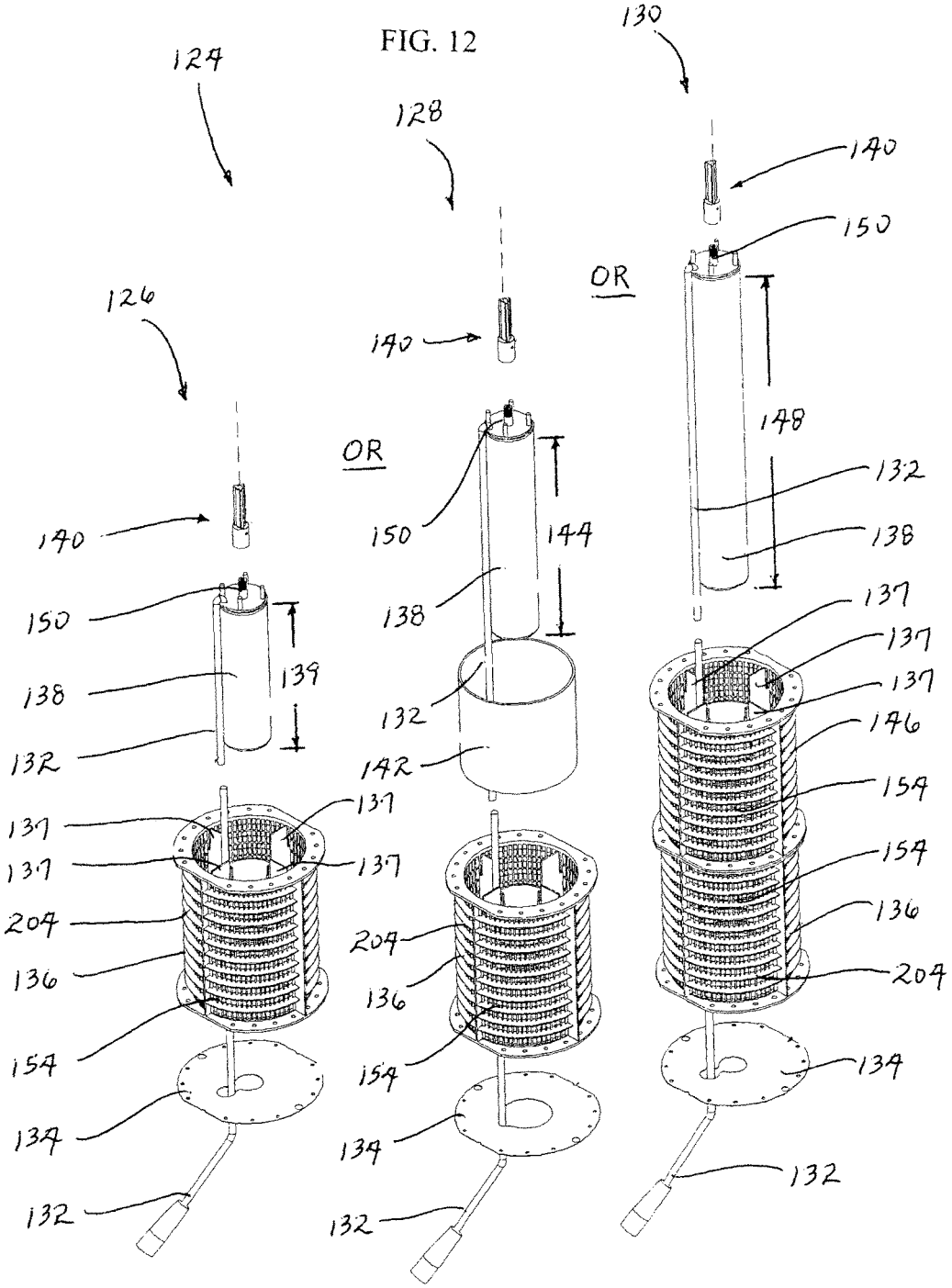

FIG. 12 is an exploded perspective view of an alternate embodiment motor assembly and, in particular, illustrating a short motor assembly, a medium motor assembly, and a long motor assembly.

Figure 13:
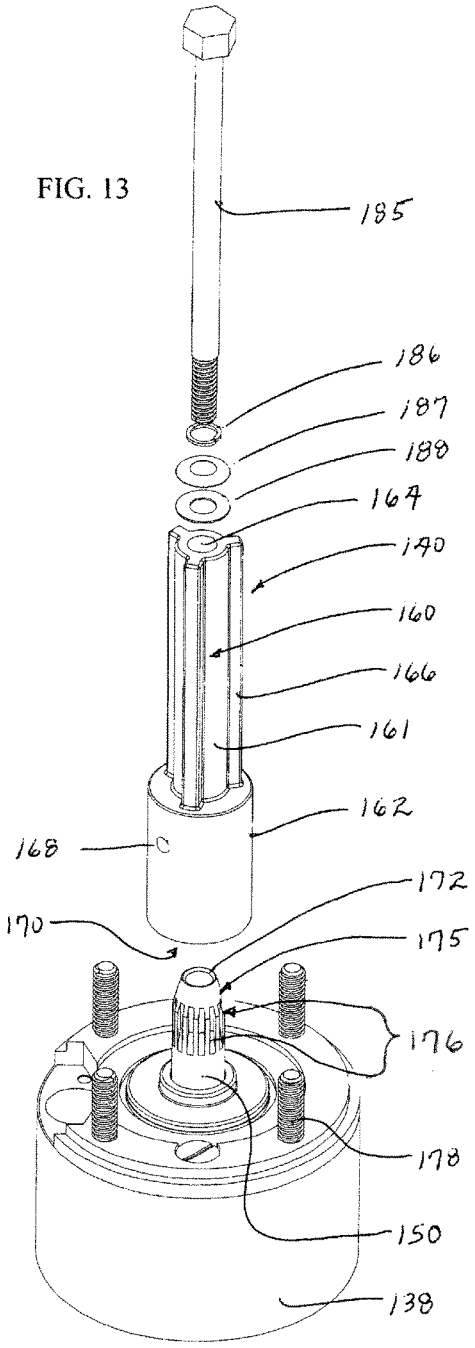

FIG. 13 is an exploded perspective view of the shaft extension for attachment to the alternate motor.

Figure 14:
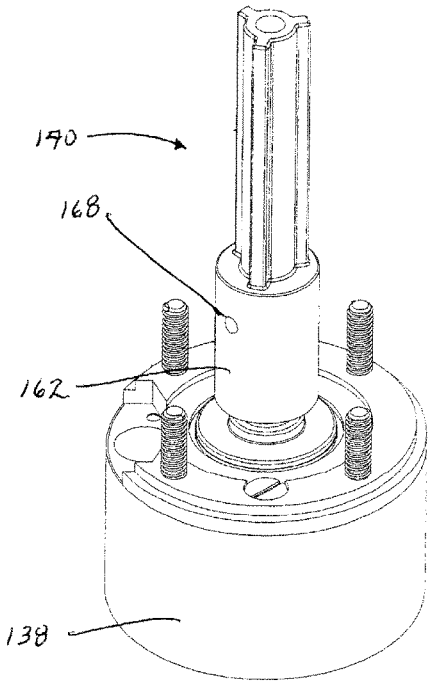

FIG. 14 is a side perspective view of the shaft extension as secured to the alternate motor.

Figure 15:
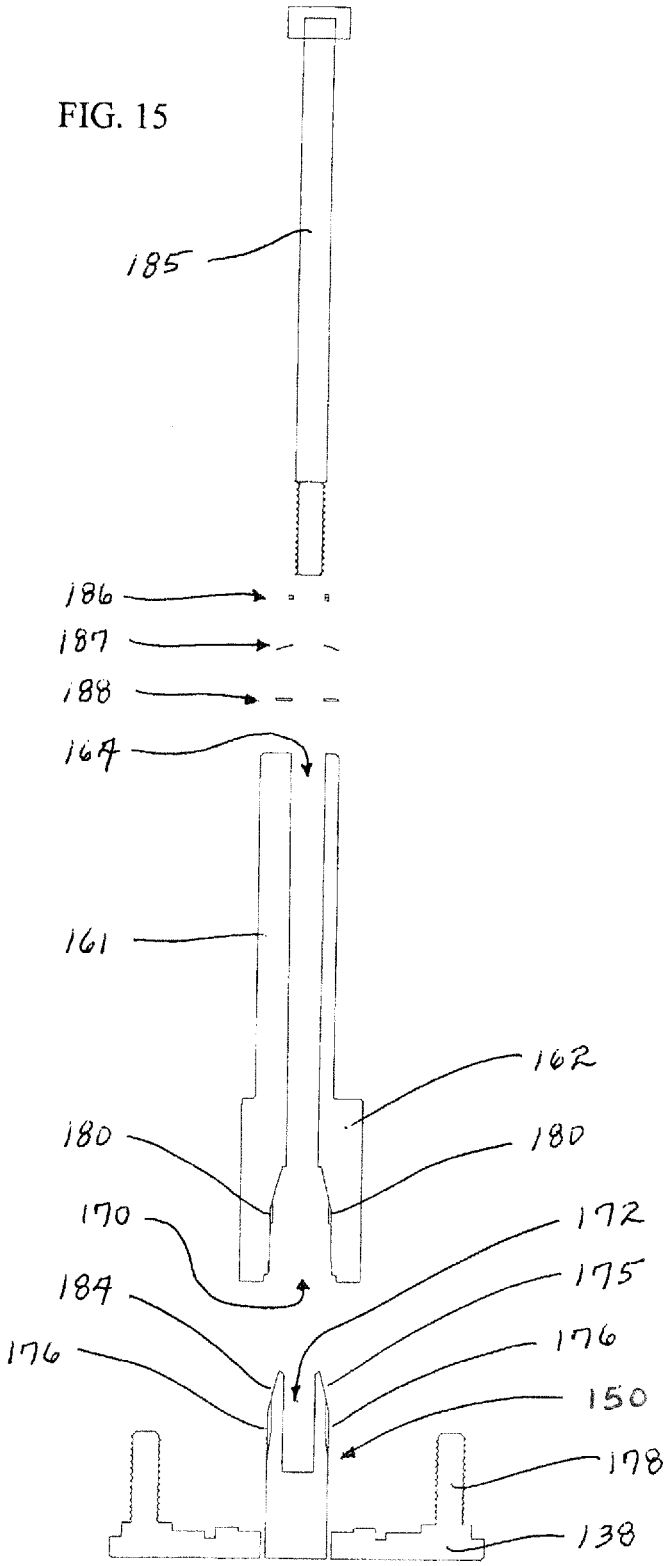

FIG. 15 is an exploded cross-sectional view of both the shaft extension and the top of the alternate motor.

Figure 16:
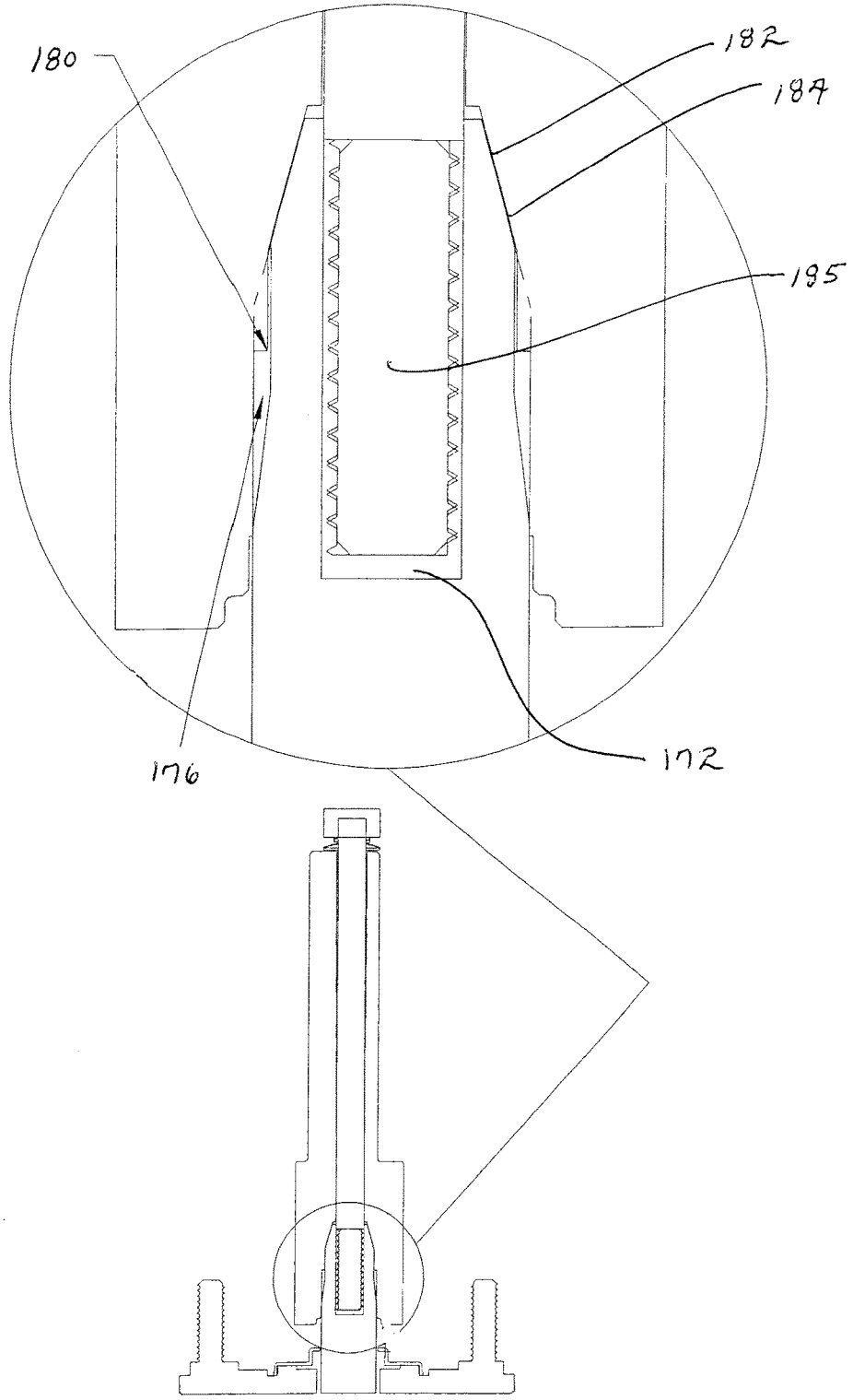

FIG. 16 is a cross-sectional view of the shaft extension as fixedly secured to the motor shaft of the alternate motor.

Figure 17A:
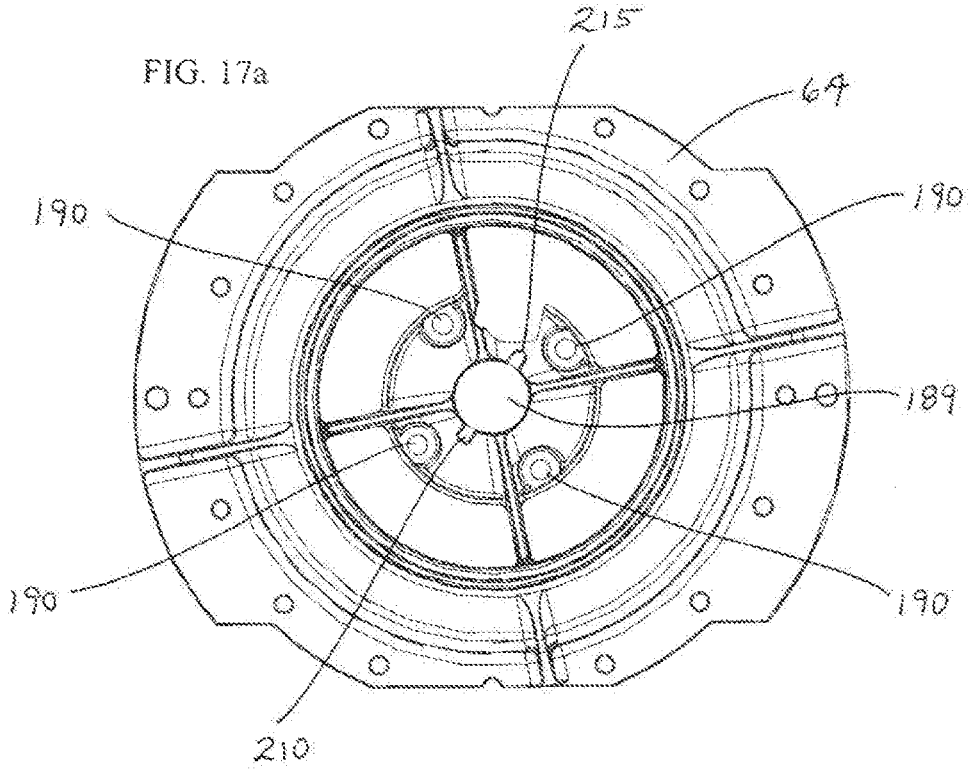

FIG. 17*a* is a top view of the plastic pump housing.

Figure 17B:
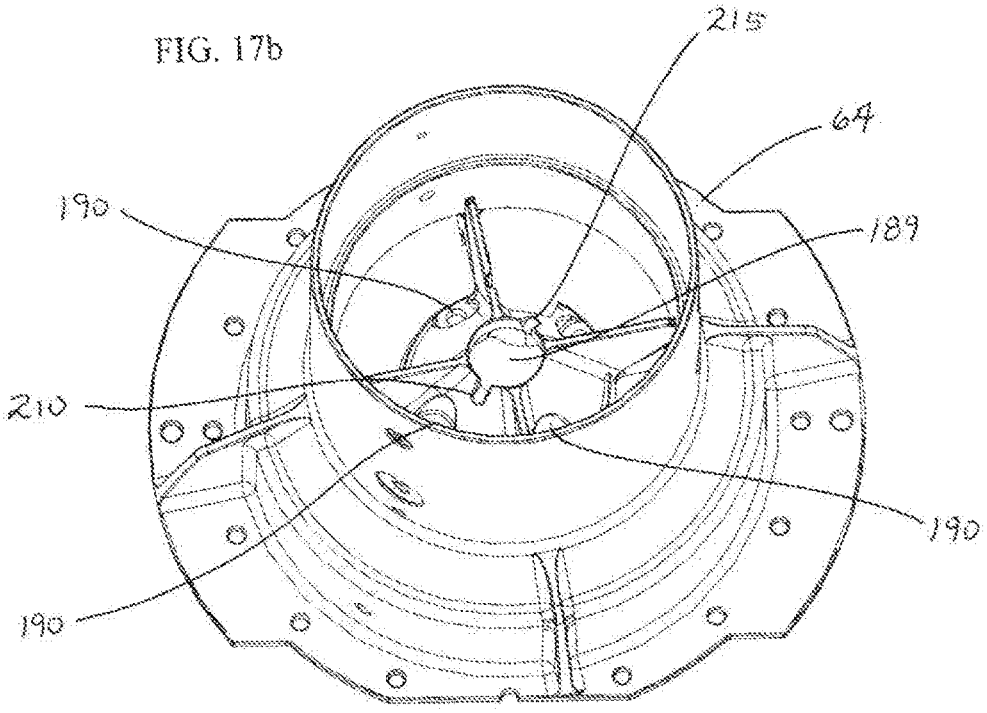

FIG. 17*b* is an isometric view from the top of the plastic pump housing.

Figure 17C:
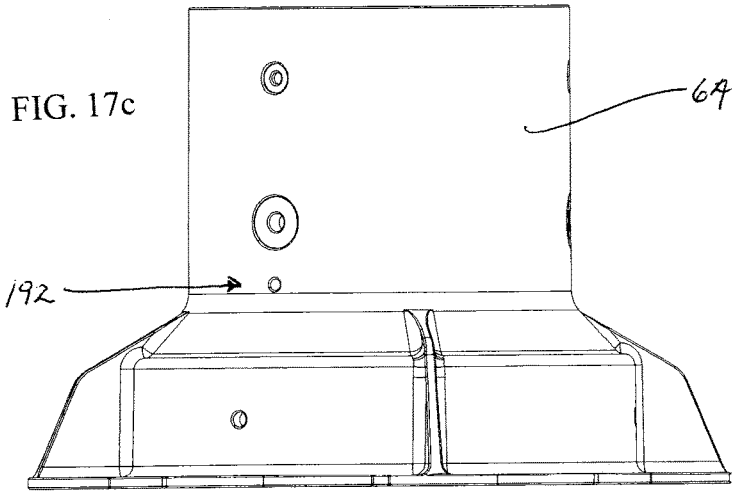

FIG. 17*c* is a side view of the plastic pump housing.

Figure 17D:
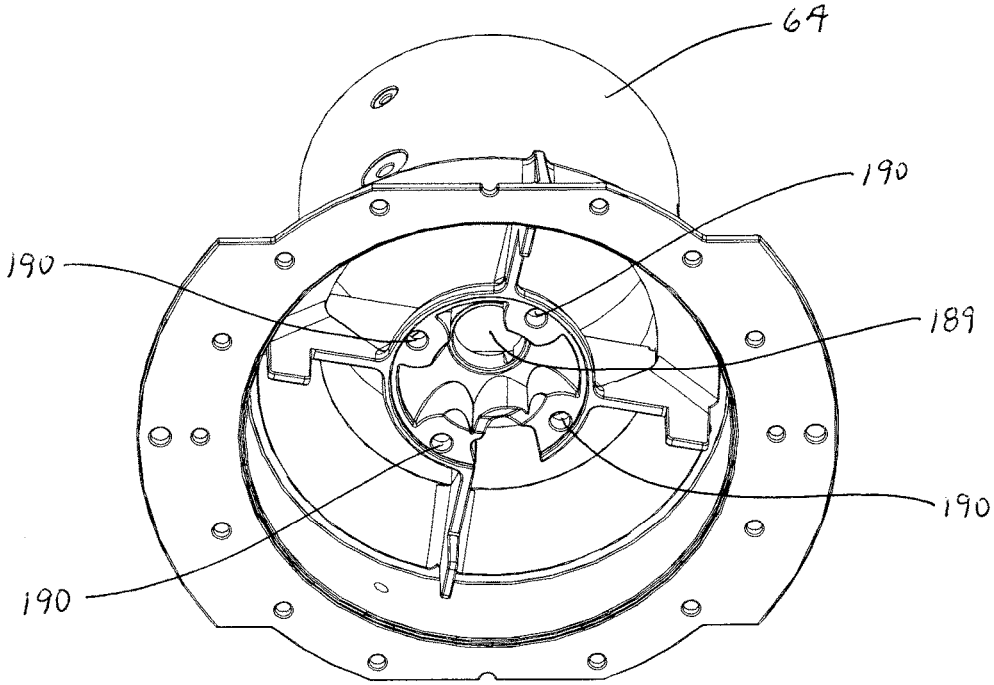

FIG. 17*d* is an isometric view from the bottom of the plastic pump housing.

Figure 18:
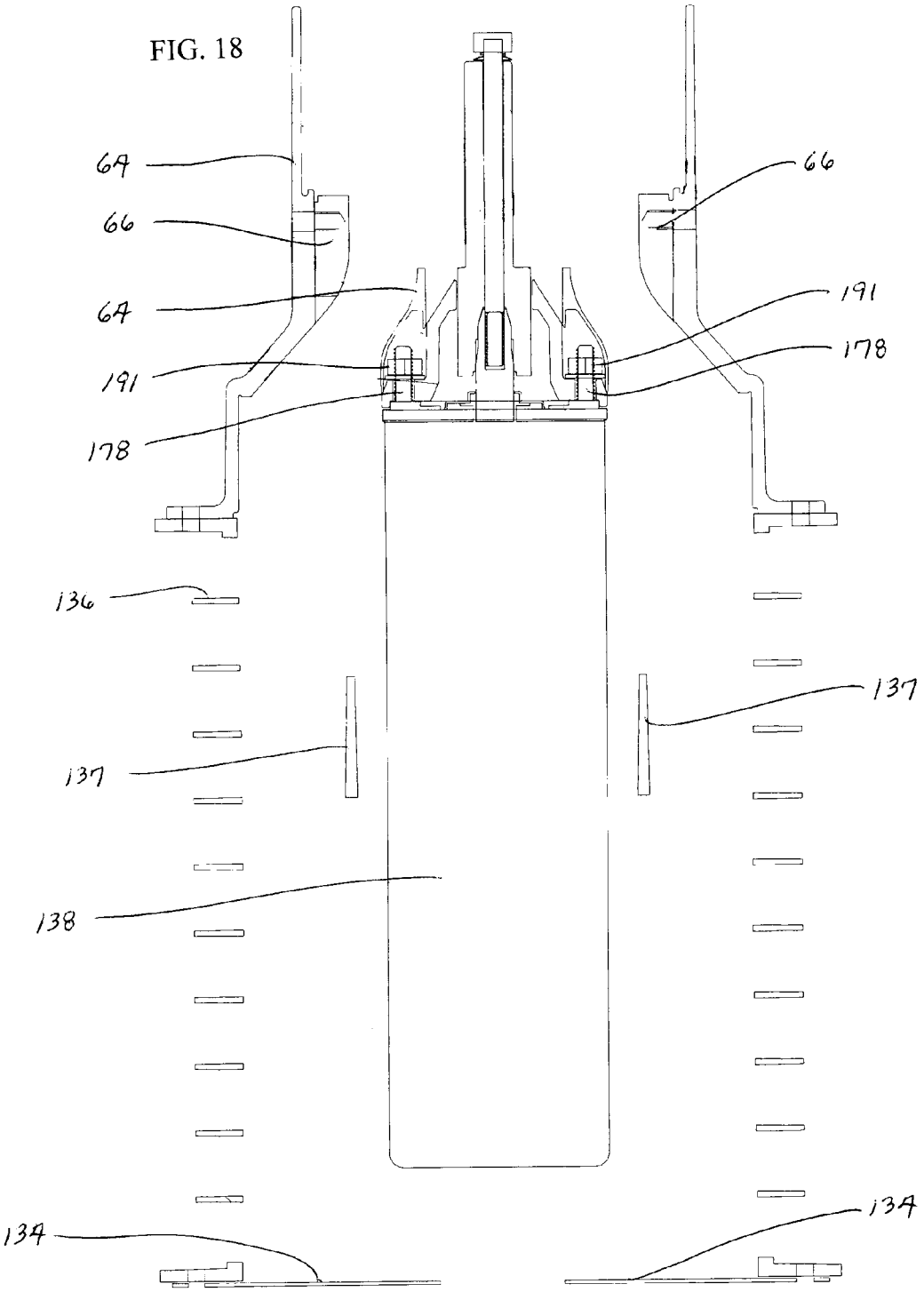

FIG. 18 is a cross sectional view of the plastic pump housing as fixedly secured to the motor assembly and the shaft extension as fixedly secured to the motor shaft of the alternate motor.

Figure 19:
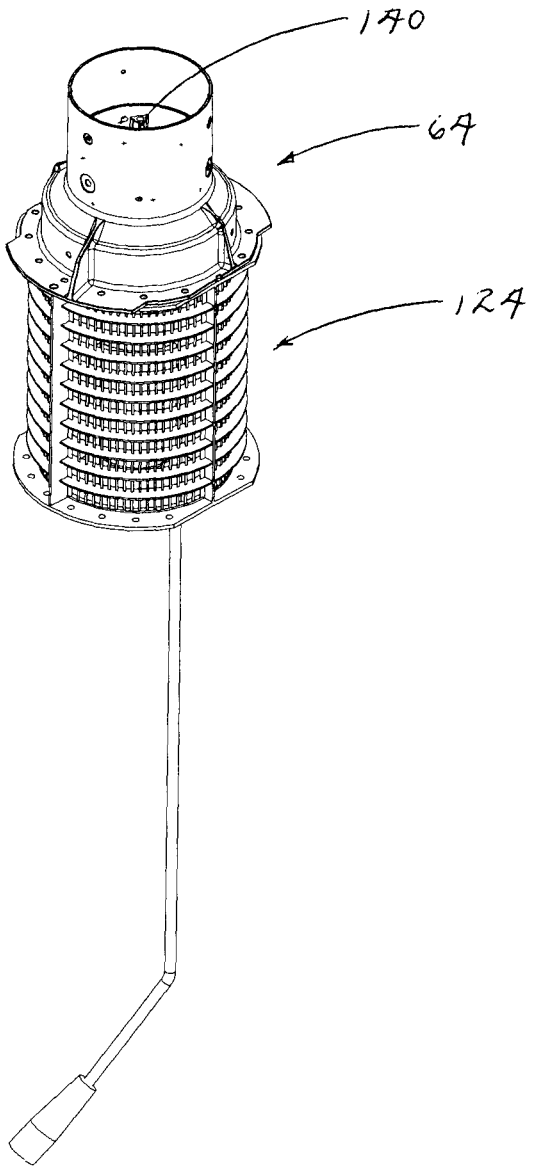

FIG. 19 is a side perspective view of the plastic pump housing as assembled to the alternate motor assembly.

Figure 20:
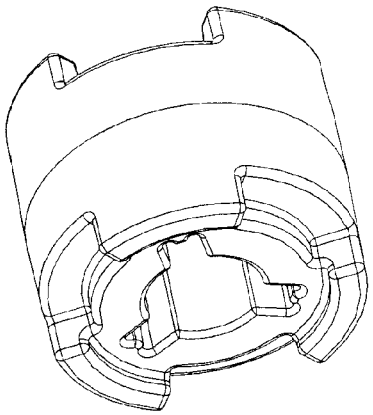
Figure 20:
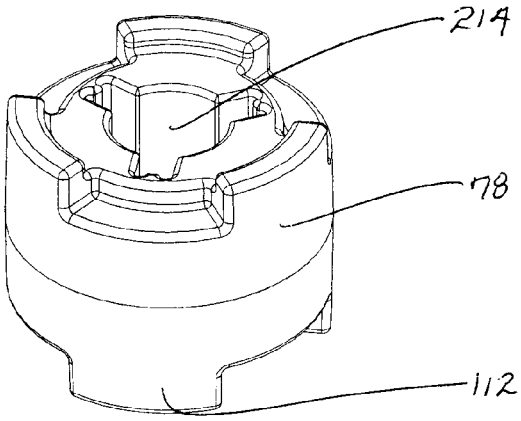
Figure 20:
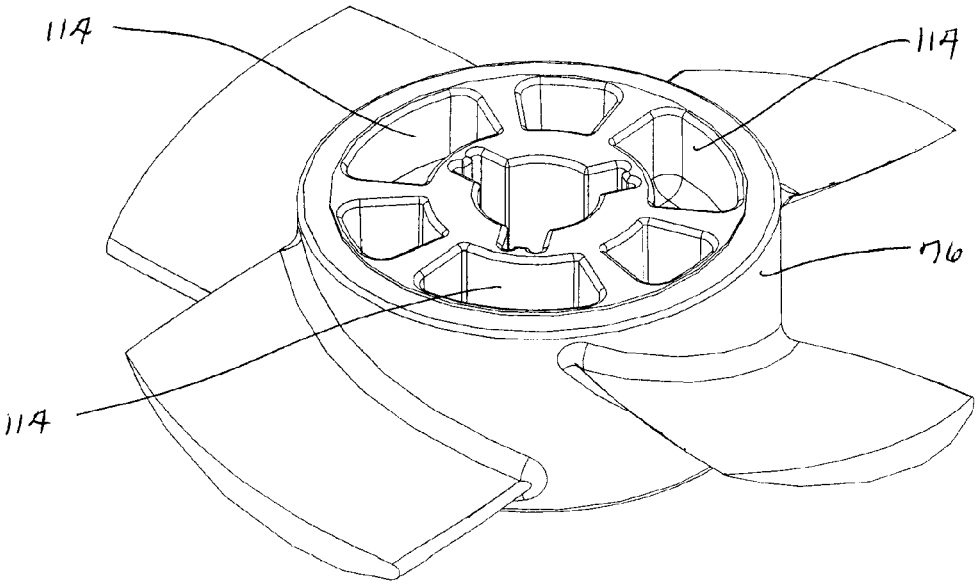

FIG. 20 is an exploded perspective view illustrating, for either the single stage or double stage pump, the propeller spacer prior to being releaseably assembled to the propeller.

Figure 21:
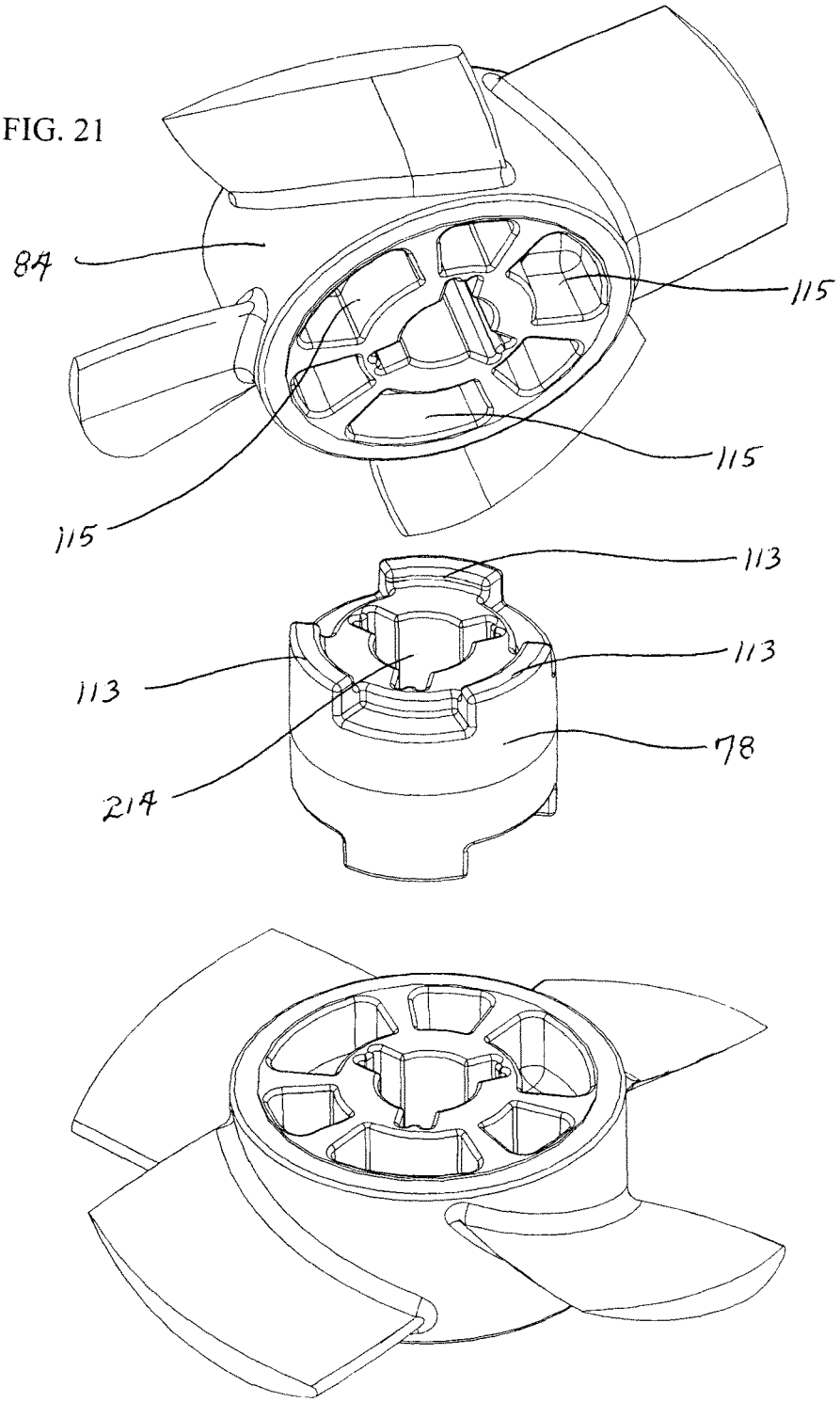

FIG. 21 is an exploded perspective view illustrating, in the double stage pump, the propeller spacer prior to being releaseably assembled to the second propeller.

Figure 22:
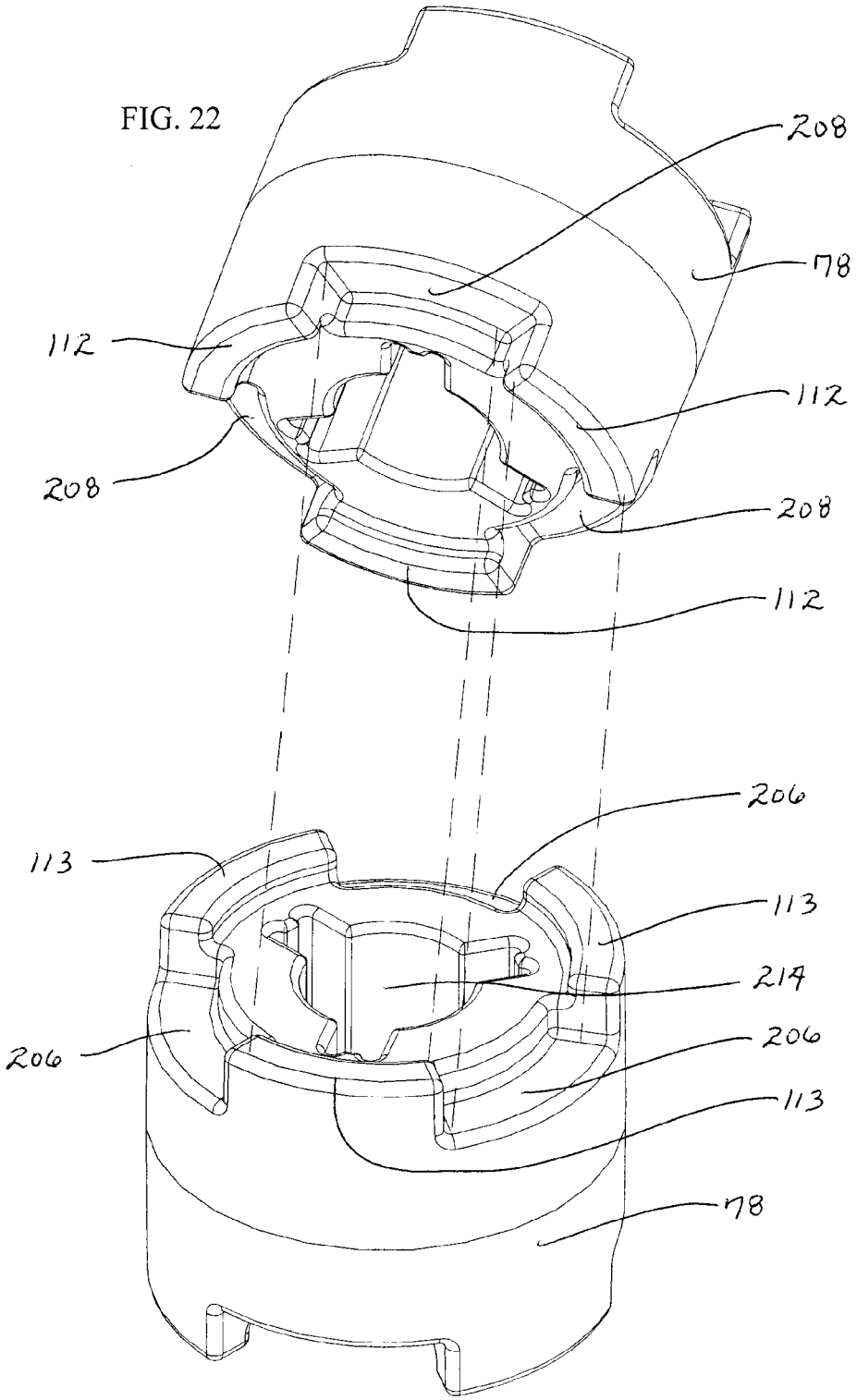

FIG. 22 is an exploded perspective view illustrating, in the single stage pump, the assembly of both of the propeller spacers to one another.

Figure 23:
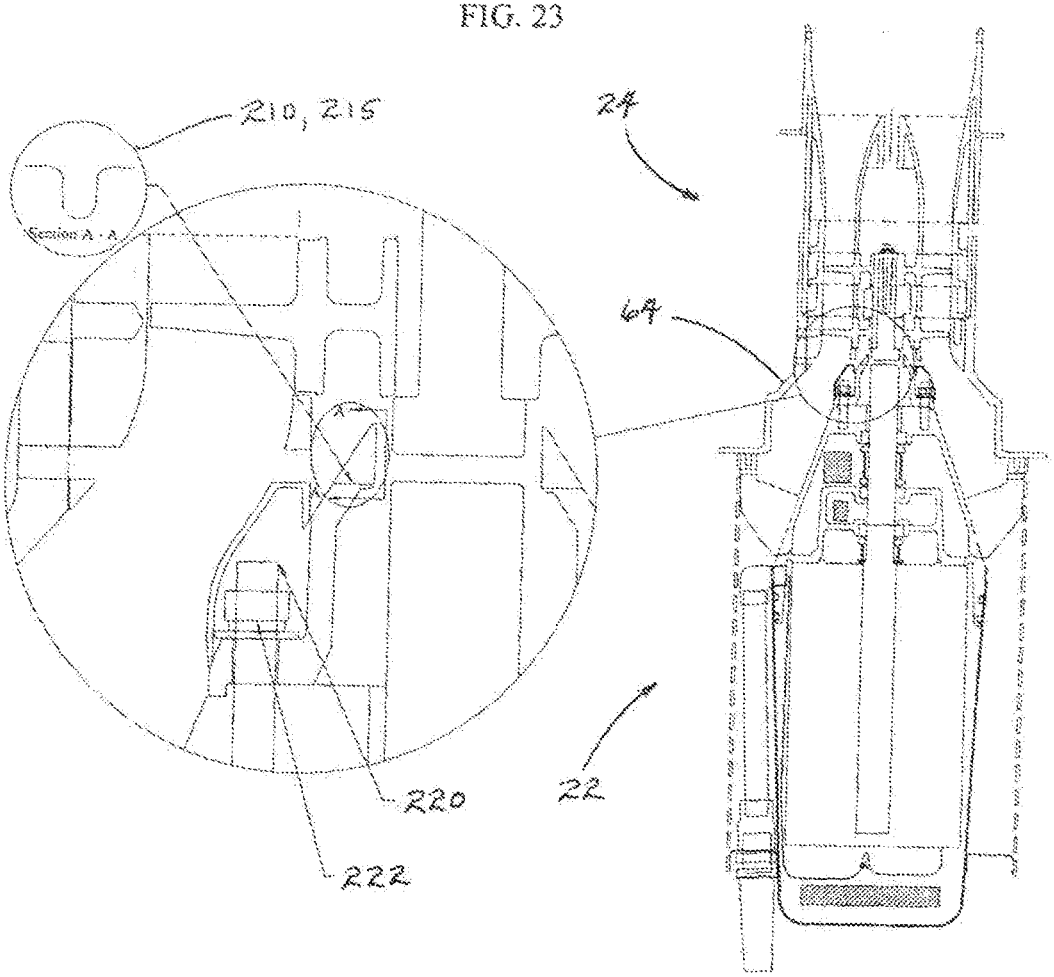

FIG. 23 is a cross-sectional view of the submersible pump apparatus illustrating, in particular, the pump installed inside the pump housing and the plastic pump housing secured to the canned motor assembly.

VI. DETAILED DESCRIPTION OF THE PREFERRED EMBODIMENT

Figure 1:
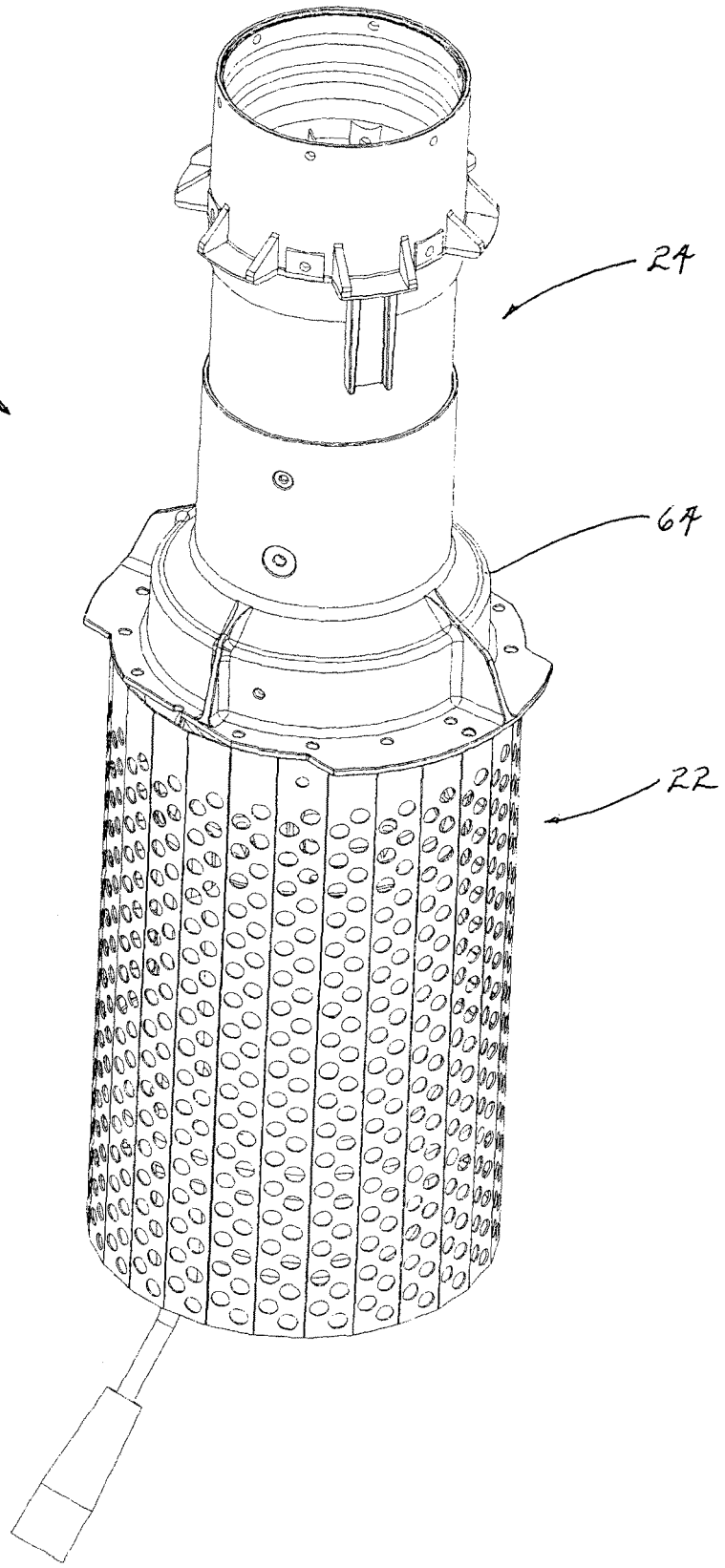
FIG. 1 is a side perspective view of Applicant's submersible pump apparatus.
Figure 2:
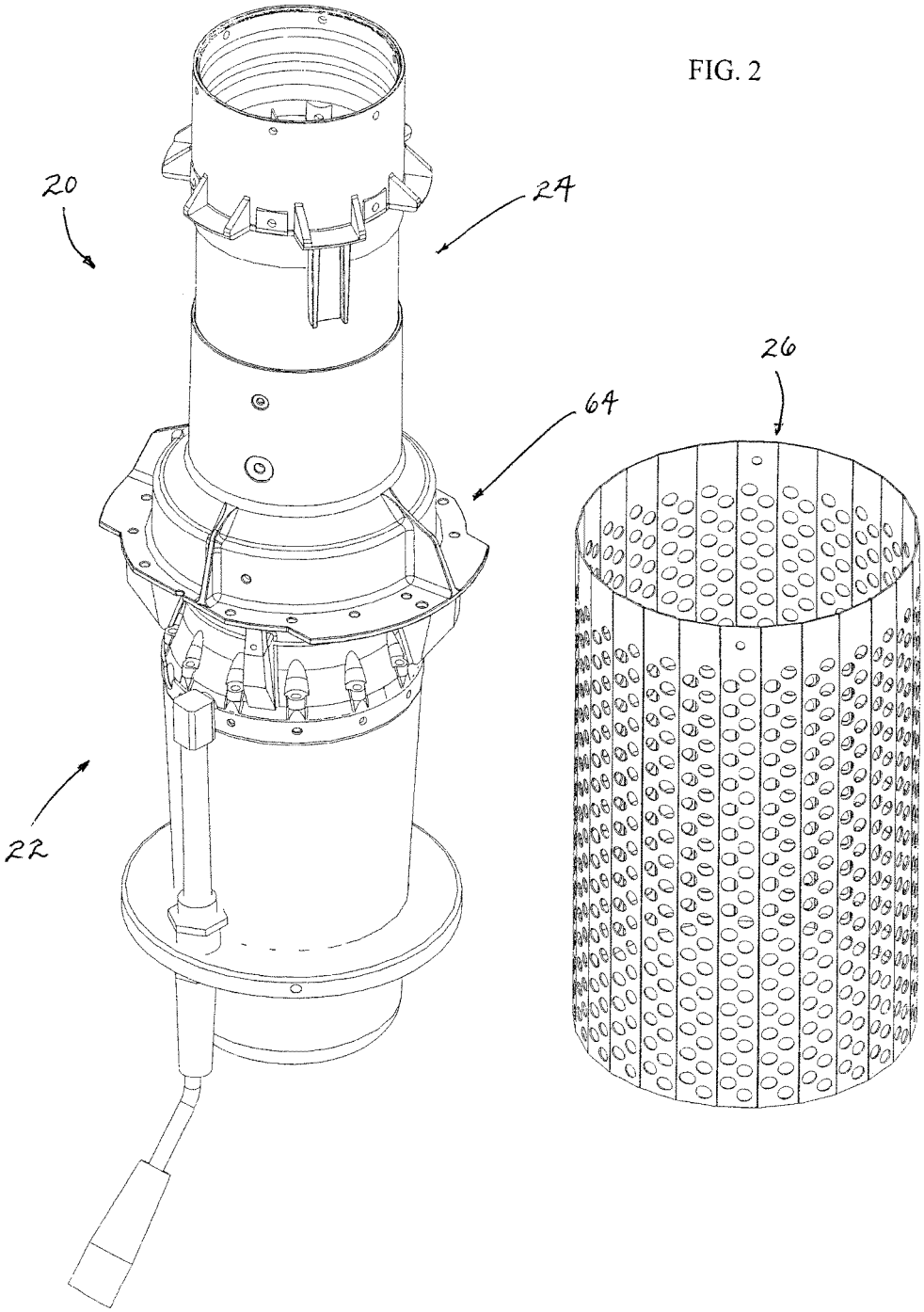
FIG. 2 is a side perspective view of the submersible pump apparatus illustrating, in particular, the canned motor assembly as connected to the pump assembly with the suction screen as detached.

Turning first to FIG. 1, there is illustrated a submersible pump apparatus 20. The submersible pump 20 comprises a canned motor assembly 22 and a pump assembly 24. The canned motor assembly 22, in its assembled form with a suction screen 26 detached, is also illustrated in FIG. 2. In the preferred embodiment, the canned motor assembly 22 is fixedly secured to the pump assembly 24 through the use of a plastic pump housing 64. This is also more clearly illustrated in FIG. 23, in which threaded studs 220 and hex nut 222 are used to accomplish the attachment.

Figure 3:
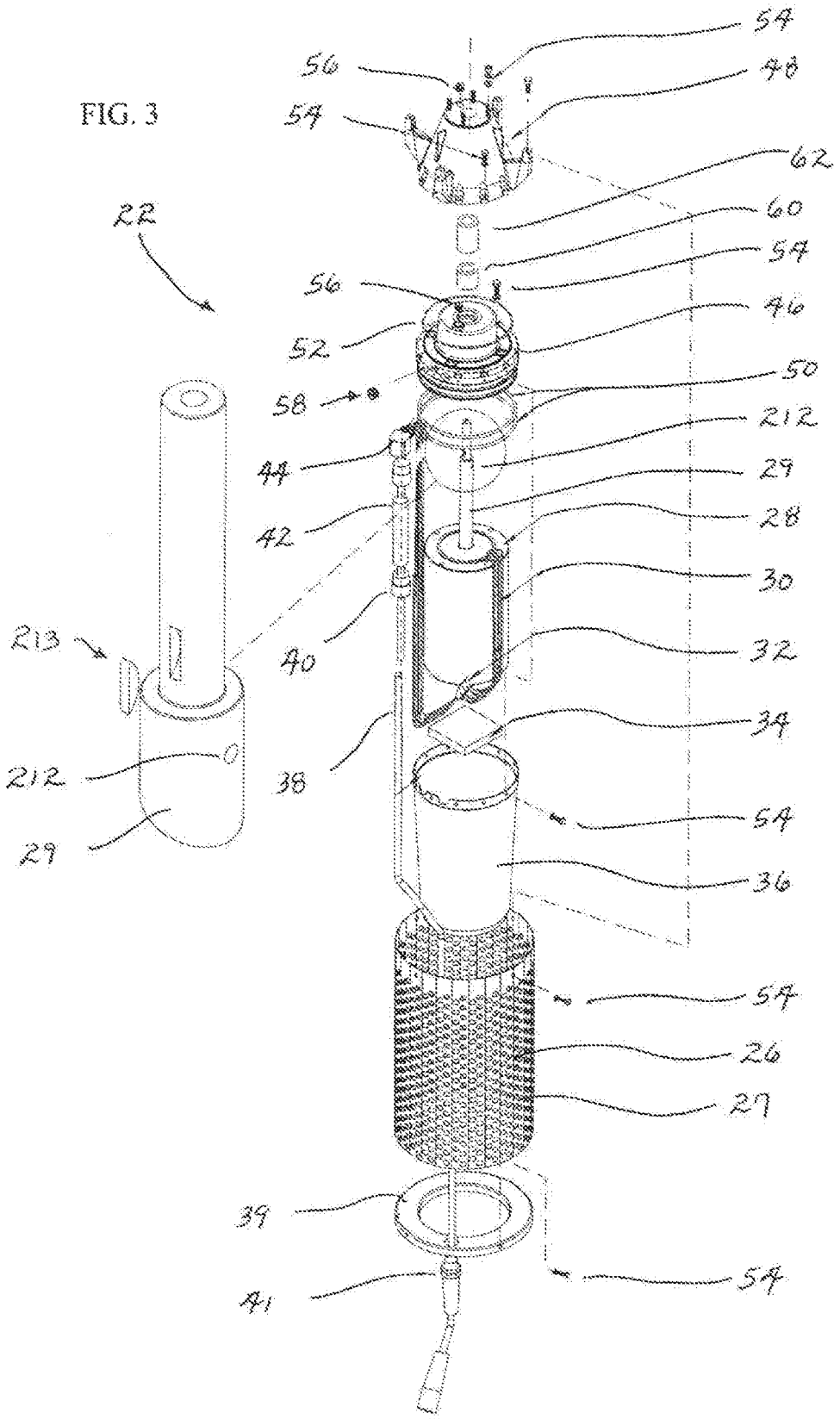
FIG. 3 is an exploded perspective view of the submersible pump apparatus illustrating, in particular, the canned motor assembly.

The canned motor assembly 22, and its components, are more clearly shown in the exploded view as illustrated in FIG. 3. As illustrated, the canned motor assembly 22 comprises a motor 28, motor shaft 29, motor wiring 30, wire connectors 32, a foam block 34, a motor can 36, a motor cable 38, a plastic adapter 40, a threaded nipple 42, and an elbow 44. The motor cable 38 extends through a suction screen annular ring 39 which utilizes an flexible plastic cable plug 41. These motor components are connected to a motor cap 46 and a seal housing 48. A double o-ring 50 is situated between the motor cap 46 and the motor can 36 and another o-ring 52 is situated between the motor cap 46 and the seal housing 48. Hex bolts, nuts, lock washers, and studs (collectively identified as 54) are used throughout the canned motor assembly 22 for connecting these various components together. Additionally, a pipe plug 56, pipe fill oil plug 58, and o-ring 50 (see FIG. 5*a*) are also used in the seal housing 48 and motor cap 46.

In the preferred embodiment, upon connecting the motor cap 46 and the seal housing 48 to the motor 28, and as discussed in further detail below, a single seal assembly 60 and a double seal assembly 62 are attached. All of the motor components and the motor cap 46 and the seal housing 48 are encased within the suction screen 26. The suction screen 26 is designed with a plurality of holes 27.

Figure 4:
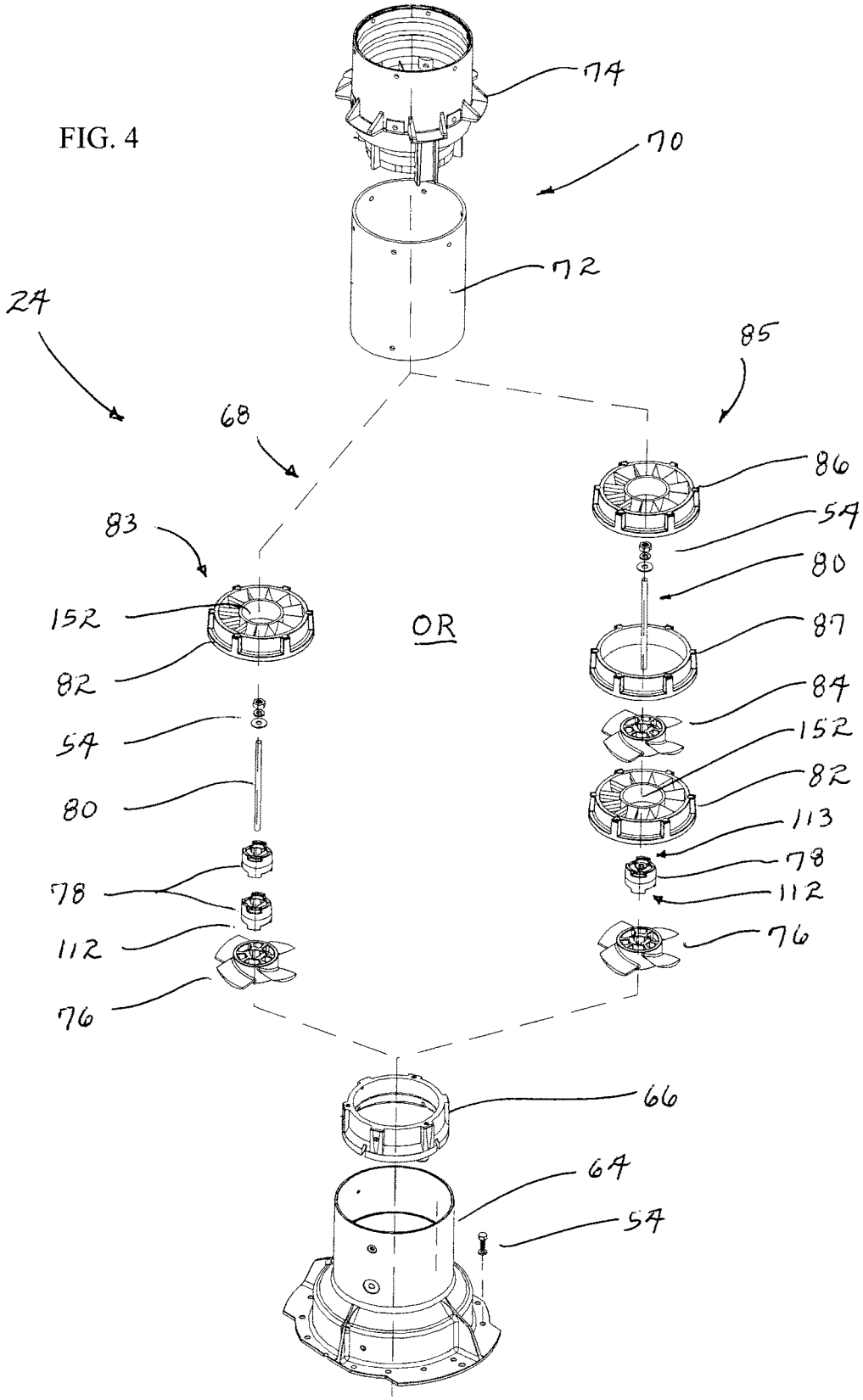
FIG. 4 is an exploded perspective view of the submersible pump apparatus illustrating, in particular, the pump assembly.

The pump assembly 24, and its components, are more clearly shown in the exploded view as illustrated in FIG. 4. As illustrated, the pump assembly 24 comprises the plastic pump housing 64, a primary shroud 66, a pump 68, and a pump discharge assembly 70 which comprises a pipe 72 and a discharge support 74. In the preferred embodiment, the pipe 72 is made of plastic and preferably a polyvinyl chloride, commonly abbreviated PVC. Hex bolts and lock washers (collectively identified as 54) are used throughout the canned motor assembly for connecting these various components together, where needed.

The pump 68 is either a single or 1-stage pump 83 or a double or 2-stage pump 85. The single stage pump 83 comprises a propeller 76, a propeller spacer 78, a threaded rod 80, and an intermediate flow straightener 82. In the double stage pump 85, a second propeller 84, a second intermediate flow straightener 86, and a secondary shroud 87 are added, as illustrated. For the canned motor assembly 22 and the pump assembly 24, these components are held together with a nut 55, as illustrated in FIG. 5*a*; and for the alternate motor with threaded the hex bolt 185, as illustrated in FIG. 13. Alternatively, additional stages can further be added to this pump in the same manner, if desired, and would be referred to as a triple or 3-stage pump, and so on.

Turning next to FIG. 5*a*, the canned motor assembly 22 (with the double stage pump 85) and the pump assembly 24, and their components, are illustrated or shown in a cross-sectional view. In particular, the single seal assembly 60 and the double seal assembly 62, as illustrated in FIG. 3, also referred to herein as "mechanical seals", are more clearly illustrated. In the preferred embodiment, when the seal housing 48 is connected or fixedly secured to the motor cap 46, the double seal assembly 62, (as illustrated in FIG. 3), is a cylindrical member encircled around the exterior of the motor shaft 29 and forms or creates two seals: (i) a first seal 92 between the seal housing 48 and the motor shaft 29, and (ii) a second seal 90 between the motor cap 46 and the motor shaft 29. Likewise, when the motor cap 46 is connected or fixedly secured to the motor 28, the single seal assembly 60, as illustrated in FIG. 3, is a cylindrical member encircled around the exterior of the motor shaft 29 and forms or creates a third seal 88 between the motor cap 46 and the motor shaft 29.

Additionally, with the motor cap 46 and the seal housing 48 collectively secured to the motor 28, a first reservoir 94 is formed or created adjacent to the double seal 62, between the first seal 92 and the second seal 90, and between the motor cap 46 and the seal housing 48. In this manner, the first reservoir 94 comprises all of the open space that exists between the exterior of the motor cap 46 and the interior of the seal housing 48. A second reservoir 96 is formed or created between the second seal 90 from the double seal assembly 62 and the third seal 88 from the single seal assembly 60 within the motor cap 46. In this manner, the second reservoir 96 comprises all of the open space that exists within this section of the motor cap 46. And a third reservoir 98 is formed or created adjacent to the third seal 88 from the single seal assembly 60 between the motor cap 46 and the motor can 36. In this manner, the third reservoir 98 comprises all of the open space that exists within this section of the motor cap 46 and, further, all of the open space that exists between the exterior of the motor 28 and the interior of the motor can 36 (i.e., including along the exterior sides of the motor 28 and the bottom of the motor can 36). In the preferred embodiment, each of the first reservoir 94, the second reservoir 96, and the third reservoir 98 are substantially filled with oil.

When this submersible pump apparatus 20, as illustrated in FIGS. 1 and 2 is in use, submerged and completely surrounded by the presence of fluid (i.e., such as water), if there is a breach or leak in the seals, Applicant's inventive design prevents the immediate destruction of the submersible pump apparatus 20.

While submerged, the submersible pump apparatus 20 is immersed or surrounded by the fluid. The submersible pump apparatus 20, while in a resting state (e.g., not engaged and pumping), permits the fluid to enter into the pump assembly 24 through the plurality of holes 27 in the suction screen 26 and fill the open space that exists within and between the pump assembly 24. When this occurs, the fluid surrounds the exterior of the seal housing 48. As the seal housing 48 is a solid component, the seals for this seal housing 48 are the only areas susceptible to breach by the fluid and leaking further toward the motor cap 46 and the motor 28. The first seal 92 that is situated between the seal housing 48 and the motor shaft 29 is the primary seal preventing the fluid from entering into the seal housing 48. The o-ring 52 and pipe plug 56 (see FIG. 3) are also providing other seals for the seal housing 48. However, these seals, due to the interconnection and tightening of these parts forming the seal, are less likely to breach before the first seal 92.

Should the fluid breach the first seal 92 (i.e., due to the gradual wearing down of the first seal 92 which then permits or allows a leak in the first seal 92), the fluid would then proceed inside the seal housing 48 and into the first reservoir 94. In typical situations like this, the breach is very small and therefore the amount of fluid entering inside the seal housing 48 and first reservoir 94 is small and, even if continuous, is at a slow rate. As the fluid enters into the seal housing 48, the fluid which is heavier than oil slowly begins to fill the bottom of the first reservoir 94. In this manner, the first reservoir 94 disperses the fluid and any contaminants at the bottom of the first reservoir 94, and the oil contained therein stays in contact with the elevated seal, preventing initially presence of the fluid directly on the seal 90, thus considerably enhancing the seal life. Thus, although fluid has breached the seal housing 48 and is slowly filling into the first reservoir 94, the submersible pump apparatus 20 continues undamaged and fully operational. As the fluid continues to further enter into the seal housing 48 and the first reservoir 94, at some point, there will be enough fluid in the first reservoir 94 such that the fluid directly engages the first seal 92.

Foam strips 102, 104, and 34 are shown are used to absorb the pressure that would be created as the fluid expands inside this chamber as it is heated by the motor 28 and the friction of the double seal assembly 62 and single seal assembly 60.

While the fluid leaked into the first reservoir 94 is directly engaging the motor cap 46 within the first reservoir 94, as the motor cap 46 is also a solid component, and as the joint between the motor cap 46 and seal housing 48 is a static o-ring 52, the second seal 90 in the motor cap 46 is the area that is next susceptible to a breach by the fluid and leaking further into reservoir 96. The second seal 90 that is situated between the motor cap 46 and the motor shaft 29 is the primary seal preventing the fluid from entering into the motor cap 46. The hex bolt and lock washers 54, double o-ring 50 (see FIG. 3), and pipe oil fill plug 58 (see also FIG. 3) are also providing other seals for the motor cap 46. However, these seals, due to the interconnection and tightening of these parts forming the seal, are less likely to breach before the second seal 90.

Should the fluid breach the second seal 90 (i.e., due to the gradual wearing down of the second seal 90 which then permits or allows a leak in the second seal 90), the fluid would then proceed inside the motor cap 46 and into the second reservoir 96. Again, in typical situations like this, the breach is very small and therefore the amount of fluid entering inside the motor cap 46 and second reservoir 96 is small and, even if continuous, is at a slow rate. As the fluid enters into the motor cap 46, the fluid slowly begins to fill the second reservoir 96. In this manner, the second reservoir 96 accumulates the fluid throughout the bottom of the second reservoir 96, preventing initially presence of the fluid directly on the third seal 88 within this section of the motor cap 46 or permitting a limited or reduced presence of the fluid directly on the third seal 88 within the motor cap 46. Also, if the oil has a density less than the fluid (i.e, water for example), the fluid will collect in a cavity 97 at the bottom of the second reservoir 96 intentionally forcing the fluid away from the third seal 88. Thus, although fluid has further breached the motor cap 46 and is slowly filling into the second reservoir 96, the submersible pump apparatus 20 continues undamaged and fully operational. As the fluid continues to further enter into the motor cap 46 and the second reservoir 96, at some point, there will be enough fluid in the second reservoir 96 that the fluid directly engages the third seal 88.

The foam strip 104 shown in the second reservoir 96 is used to absorb the pressure that would be created as the fluid expands inside this chamber as it heated by the motor 28 and the friction of both the double seal assembly 62 and single seal assembly 60.

Should the fluid breach the third seal 88 (i.e., due to the gradual wearing down of the third seal 88 which then permits or allows a leak in the third seal 88), the fluid would then proceed into the third reservoir 98. Again, in typical situations like this, the breach is very small and therefore the amount of fluid further entering inside the third reservoir 98 is small and, even if continuous, only slowly begins to fill the third reservoir 98. In this manner, the third reservoir 98 accumulates the fluid at the bottom of the third reservoir 98 away from the motor. Thus, although fluid has further breached the seal 88 and is slowly filling into the third reservoir 98, the submersible pump apparatus 20 continues undamaged and fully operational.

As the fluid continues to further enter into the third reservoir 98, at some point, there will be enough fluid in the third reservoir 98 that the fluid directly engages the electrical connections 32 to the motor. In the event this occurs, the wire connectors 32 situated above the foam and adjacent to the bottom of the motor 28 will permit a breach into the motor wires 30 and if the fluid is even slightly conductive, as water is, an electrical fault interruption (e.g., like a ground fault circuit interruption or GFCI) can shut off the motor power to prevent the fluid from reaching the motor 28 and thereby prevent a short circuit in the motor to save the motor 28 from failure.

Based on the foregoing, however, this submersible pump apparatus 20, as invented and designed by Applicant: (1) extends and/or prolongs the life of submersible pumps; (2) prevents the immediate destruction of the submersible pump motor in the event of a breach of the seals by the fluid; and (3) even in the event of a breach: (a) provides at least three different seals to protect the submersible pump apparatus 20, (b) provides at least three different reservoirs to collect the fluid, (c) stores the collected fluid away from pump and motor components that could be damaged by the fluid, (d) prevents premature failure of the submersible pump apparatus 20, and (e) thereby saves major pump and motor replacement costs for the user.

Referring back to the pump 68 (see FIG. 4), in one embodiment, the propeller 76 used in the single stage pump 83 may be the exact same as the propeller 76 and the second propeller 84 used in the double stage pump 85. This propeller is more clearly illustrated in FIGS. 6 and 7. Alternatively, the propeller 76 used in the single stage pump 83, depending upon the horse power of the motor 28, may have a different pitch in the blades 106 (see FIG. 6) than the propeller 76 and the second propeller 84, where the horse power of the motor 28 in the double stage pump 85 is different to provide optimal results for that configuration. Additionally, in the one embodiment, the intermediate flow straightener 82 used in the single stage pump 83 is the exact same as the intermediate flow straightener 82 and the second intermediate flow straightener 86 used in the double stage pump 85. Alternatively, the intermediate flow straightener 82 used in the single stage pump 83 can be different than the intermediate flow straightener 82 and the second intermediate flow straightener 86 used in the double stage pump 85 provided that it accomplishes the same purpose as set forth herein. This intermediate flow straightener is more clearly illustrated in FIGS. 8 and 9.

In its assembled form, the double stage pump 85 and, in particular, the propeller 76, the propeller spacer 78, the intermediate flow straightener 82, the second propeller 84, and the second intermediate flow straightener 86 are also all more clearly illustrated in FIG. 10.

In use, when an electrical current is sent down an electrical wire (not illustrated) through the GFCI to the motor cable 38 and the motor wiring 30 to energize the motor 28 of the submersible pump apparatus 20, the propeller 76 (in the single stage pump 83) or the propeller 76 and the second propeller 84 (in the double stage pump 85) begin rotating. The rotation of the propeller 76 (in the single stage pump 83) or the propeller 76 and the second propeller 84 (in the double stage pump 85) begin to force the fluid within the pump assembly 24 toward the pump discharge assembly 70. This in turn likewise creates a negative pressure within the inlet of the pump assembly 24 and the submersible pump apparatus 20 that forces the fluid surrounding the submersible pump apparatus 20 (e.g., water) through the holes 27 of the suction screen 26 and into the body of the pump assembly 24 of the submersible pump apparatus 20. The propeller 76 (in the single stage pump 83) or the propeller 76 and the second propeller 84 (in the double stage pump 85) are each provided with the preferred embodiment of four (4) blades 106 (see FIGS. 6 and 7). Alternatively, the propeller 76 may contain a minimum of two (2) or more blades 106, as desired. Each of these blades 106 are fixedly attached to a propeller hub 108 and provided with a curvilinear arc 110. The blades 106 of the propeller 76 direct, through its rotation and use of the curvilinear arc 110, the flow of the fluid past the propeller 76 and toward the intermediate flow straightener 82. The blades 106 of the second propeller 84 direct, through its rotation and use of the curvilinear arc 110, the flow of the fluid past the second propeller 84 and toward the second intermediate flow straightener 86. The propeller spacer 78 have vertical tongues 112 (see FIG. 4) that are releaseably coupled or interlocking to corresponding notches 114 (see FIGS. 6 and 7) in the propeller 76 and/or the second propeller 84. This is also more clearly illustrated in FIG. 20. In this manner, the propeller spacer 78 is releaseably secured to the propeller 76. In the single stage pump 83, there is an extra propeller spacer 78 which is releaseably coupled to or interlocking to the other propeller spacer 78. As illustrated in FIG. 22, the vertical tongues 112 of extra propeller spacer 78 is aligned with, inserted, and received into corresponding recesses 206 in the other propeller spacer 78. This alignment is accomplished by rotating the propeller spacer 78 through sixty degrees (60°) relative to the other propeller spacer 78. As this occurs, the vertical tongues 113 of the other propeller spacer 78 are aligned with, inserted, and received into corresponding recesses 208 in the extra propeller spacer 78. In this manner, each of the propeller spacers 78, in the single stage pump 83, are releaseably coupled or interlocked to one another, and the internal splines remain aligned.

In the preferred embodiment, the propeller spacer 78 is situated or mated, and freely rotatable, inside the center opening 152 (see FIGS. 4 and 8) of the intermediate flow straightener 82 (see also FIGS. 5(*a*) and 10). Additionally, the propeller 76 and the spacer 78, having a female spline 214 (see FIGS. 20-22), is coupled to or interlocking with the motor shaft extension 140 (in the alternate motor assembly 124) (see FIGS. 12-19). A woodruff key 213, as illustrated in FIG. 3, in the motor shaft 29 of the canned motor assembly 24 engages one of the 3 internal splines 202 in the propeller to drive the propeller. If multiple propellers are being used, each propeller above the lowest is driven by the vertical tongues of the spacer above it. Thus, all propellers are positively driven.

Thus, when the motor 28 is energized, the motor 28 causes the motor shaft 29 to rotate. The motor shaft 29 and woodruff key 213 (as illustrated in FIG. 3) rotate and in turn causes the propeller 76 (in the single stage pump 83 to rotate. Then the propeller spacer 78, which is coupled to or interlocking with the propeller 76 below likewise rotates. In the double stage pump 85, the propeller spacer 78, is coupled to or interlocking with the second propeller 84 (as discussed in further detail below), causes the second propeller 84 (i.e., which is not coupled to or interlocking with the motor shaft 29 in the canned motor assembly 22 embodiment) to likewise rotate.

In the double stage pump 85, the propeller spacer 78 has vertical tongues 113 (see FIG. 4) that are releaseably coupled or interlocking to corresponding notches 115 in the bottom of the second propeller 84 (see FIG. 6), and as more clearly illustrated in FIG. 21. In the preferred embodiment, the notches 114 (see FIG. 6) in the top of the propeller 76 are the exact same as, the notches 115 (see FIG. 21) in the bottom of the second propeller 84 except they are all rotated 60 relative to the internal splines. In this manner, the propeller spacer 78 in the double stage pump 85 drives the second propeller 84.

Although being forced to move through the pump assembly 24 in the same direction, the rotation of the propeller 76 causes the fluid to swirl into a turbulent state within the pump assembly 24. When the fluid passes the propeller 76 and into the intermediate flow straightener 82, the intermediate flow straightener 82 uses a plurality of vanes 116 (see FIGS. 8 and 9) arranged circumferentially between a center wall 118 and an exterior wall 120 of the intermediate flow straightener 82. Each of the vanes 116 are provided with a curvilinear arc 122. The curvilinear arc 122 of the vanes 116 is also more clearly illustrated in FIG. 11. In the preferred embodiment, the curvilinear arc 122 of each vane 116 starts or is positioned at an angle 156 to the vertical and ends in a position at substantially a zero degree (0°) angle 158 to the vertical. In the preferred embodiment, the angle 156 varies or is proportionally varied between the exterior wall 120 and the center wall 118. In this manner, the curvilinear arc 122 acts to reduce the swirling or turbulent state of the fluid and force the fluid into a substantially straight, smooth state as the fluid is discharged from the intermediate flow straightener 82. This occurs during the "first stage" of the pump.

In the double stage pump 85, the second propeller 84 and the second intermediate flow straightener 86 are aligned in series with the propeller 76 and the intermediate flow straightener 82 such that the discharge from the "first stage" of the pump becomes the intake for the "second stage" of the pump. As the fluid passes through this second stage, (a) the rotation of the second propeller 84 again causes the fluid to swirl into a turbulent state within the pump assembly 24, (b) the second flow straightener 86 uses the plurality of vanes 116 to again reduce the swirling or turbulent state of the fluid and force the fluid into a substantially straight, smooth state, (c) the pressure exerted upon the fluid is increased by substantially double from the pressure resulting from the first stage of the pump, and (d) the fluid from the second intermediate flow straightener 86 is discharged up and through the pump discharge assembly 70 of the submersible pump apparatus 20 and directed to the surface.

In an alternate embodiment, a float 217, as illustrated in FIG. 5*b*, may be secured to the pump assembly 24 in order to float the submersible pump apparatus 20 discharge at the surface such that the submersible pump apparatus 20 may be used, for example, as a floating fountain.

When the electrical current is discontinued through the electrical wire (not illustrated) to the motor cable 38 and the motor wiring 30, the motor 28 becomes disengaged, the propeller 76 (in the single stage pump 83) or the propeller 76, the propeller spacer 78, and the second propeller 84 (in the double stage pump 85) stop rotating, the fluid is no longer being sucked or pulled into and forced through the body of the pump assembly 24, thereby, stopping the operation of the submersible pump apparatus 20.

In an alternate embodiment, the submersible pump 20 comprises a motor assembly 124, as illustrated in FIG. 12, for combination with the pump assembly 24, as illustrated and described in FIGS. 1-5. In this embodiment and as described in further detail below, the motor assembly 124 is fixedly secured to the pump assembly 24 through the use of the plastic pump housing 64. Thus, in either the preferred embodiment or in this alternate embodiment, the plastic pump housing 64 is used to connect the canned motor assembly 22 or the motor assembly 124 to the pump assembly 24.

In this embodiment, the motor assembly 124 is preferably a four inch (4") diameter motor and, depending upon the desired use and horse power, can have varying length, simply referred to herein as a short motor assembly 126, a medium motor assembly 128, or a long motor assembly 130.

The short motor assembly 126 comprises a motor cable assembly 132, a suction screen end plate 134, a suction screen 136 having a plurality of internal fins 137 to support the 4" motor, a suction screen having a plurality of small openings to keep large and damaging debris away from the pump, a motor 138 having a short motor length 139, and a shaft extension 140. The medium motor assembly 128 comprises the same components as the short motor assembly 126 with the addition of an extension tube 142 to facilitate the length of the motor 138 which has a medium motor length 144. The long motor assembly 130 has the same components as the short motor assembly 126 with the addition of a second suction screen 146 to facilitate the length of the motor 138 which has a long motor length 148.

Each of the suction screen 136 and second suction screen 146 (in the long motor assembly 130) are provided with a plurality of fins 137 (see also FIG. 18). The plurality of fins 137 are used, when the motor 138 is inserted into the suction screen 136 and the second suction screen 146 (in the long motor assembly 130), to frictionally assist in securing the motor 138 within the motor assembly 124, and, by using the coupling or mating of the plurality of fins 137 with the motor 138, further assists in providing additional strengthening of the suction screen 136 and the second suction screen 146 (in the long motor assembly 130).

With the addition of the second suction screen 146, the second suction screen 146 facilitates additional suction area for the long motor assembly 130. In the preferred embodiment, the suction screen 136 is identical to the second suction screen 146. Additionally, the suction screen 136 and the second suction screen 146 are each provided with a plurality of holes 154 that are small enough to prevent debris or other contaminants from being sucked or pulled into the pump assembly 124 and disrupt the flow of the fluid through the submersible pump apparatus 20. If desired, the suction screen 146 can be further stacked (i.e, connected end to end) to additional suction screens 146 (i.e., a third suction screen, fourth suction screen, etc.) to create a suction screen of virtually any length and thereby achieve a maximum suction area, as desired.

The suction screen 136 and the second suction screen 146 are each also provided with, amongst the plurality of holes 154, a plurality of annular ridges 204. The plurality of annular ridges 204 provides additional support, further strengthens the suction screen 136 and second suction screen 146, assists in making the suction screen 136 and second suction screen 146 resistant to collapse, and collects external debris or other contaminants for easy cleaning.

Preferably, the medium motor length 144 is longer than the short motor length 139 and the long motor length 148 is longer than the medium motor length 144. As the length of the motor increases, the horse power of the motor 138 for the medium motor assembly 128 is greater than the horse power of the motor 138 for the short motor assembly 126. Likewise, the horse power of the motor 138 for the long motor assembly 130 is greater than the horse power of the motor 138 for the medium motor assembly 128.

As the standard motor shaft 150 is short, the shaft extension 140 facilitates allowing positioning the first propeller so that a smooth water flow over the motor 138 and into the first propeller could be achieved, which could not be achieved without the shaft extension 140. In addition, the shaft extension 140 is long enough to allow and facilitate a driving mechanism for both the single stage pump 83 or the double stage pump 85 to be employed in the submersible pump apparatus 20. Additionally, the shaft extension 140 incorporates a male spline 160 (see FIG. 13) and a plurality of teeth 166 to engage and drive the propellers 76 (in the single stage pump 83) or the propeller 76 and second propeller 84 (in the double stage pump 85) creating a simple, effective, and positive drive. In addition, the male spline 160 and teeth 166 are designed by their size, thickness, and being fixedly secured to the shaft extension 140 to dramatically increase the stiffness of the shaft extension 140.

As illustrated in FIG. 13, the shaft extension 140 and the motor 138 of the motor assembly 124 are more clearly illustrated. In this embodiment, the shaft extension 140 comprises the male spline 160 and a spline base 162. In the preferred embodiment, the male spline 160 comprises a cylindrical member 161 having a hollow bore 164 and a plurality of teeth 166 extending outwardly from the exterior of the cylindrical member 161. The spline base 162 comprises a hole 168 and a tapered and splined bore 170 contained therein (see also FIGS. 15 and 16). The motor 138 comprises a motor shaft 150 having a tapped hole 172, a male spline 176, and a tapered end. The shaft end of the motor 138 has a plurality of threaded studs 178. The male spline 176 further provides a tapered top 175.

The means for attaching the shaft extension 140 to the motor 138 of the motor assembly 124 is more clearly illustrated in FIGS. 14-16. As illustrated in FIG. 14, the spline base 162 of the shaft extension 140 is aligned with and positioned over the motor shaft 150 of the motor 138. When this occurs, as illustrated in FIG. 15, the tapered and splined bore 170 of the spline base 162 is positioned to be mated with the male spline 176 of the motor shaft 150. A plurality of teeth 180 contained within the tapered and splined bore 170 are aligned with and frictionally received into the corresponding male spline 176 (see also FIG. 16). Also, the tapered surface 182 of the tapered and splined bore 170 engages with and mates to the tapered surface 184 of the motor shaft 150 (see also FIG. 16). A threaded hex bolt 185, lock washer 186, Bellville washer 187, and a flat washer 188 are then used to fixedly secure the shaft extension 140 and the propeller or propellers and spacer or spacers to the motor 138 as the threaded hex bolt 185 is inserted into and received into the threaded tapped hole 172 in the motor shaft 150 (see also FIG. 16). This arrangement with mating tapers creates a very strong and concentric shaft extension.

Thus, in this alternate embodiment, when the motor 28 is energized, the motor 28 causes the motor shaft 150 to rotate. The motor shaft 150 in turn causes the shaft extension 140 which is coupled to or interlocking with the motor shaft 29 by the motor spline, to likewise rotate. The shaft extension 140 in turn causes the propeller 76 and second propeller 84, which is also coupled to or interlocking with the shaft extension 140 (in both the single stage pump 83 and the double stage pump 85), to likewise rotate. The shaft extension 140 is coupled to or interlocking with the propeller 76 and the second propeller 84 when the male spline 160 and, in particular, the plurality of teeth 166 (see FIG. 13) are received into the female splines 202 of the propeller 76 and the second propeller 84 (see FIG. 6) and, in particular, the plurality of teeth 166 of the male spline 160 are likewise received into the corresponding roots 202 in the female spline 200. In this manner, the shaft extension 140, in this motor assembly 124, is secured to and acts as a driving mechanism of both the propeller 76 and the second propeller 84.

The means for attaching the plastic pump housing 64 to the motor 138 of the motor assembly 124 is more clearly illustrated in FIGS. 17-18. In the preferred embodiment and as illustrated in FIG. 17(*a*)-(*d*), the plastic pump housing 64 is provided with a center hole 189, a plurality of holes 190, and an external hole 192. As illustrated in FIG. 18, upon positioning and aligning the plurality of holes 190 of the plastic pump housing 64 over the corresponding threaded studs 178 of the motor 138 and the tightening of hex nut 191 over the threaded studs 178, the plastic pump housing 64 is fixedly secured to the motor 138. This motor 138 and plastic pump housing 64 can then be secured to the suction screen 136 to complete this embodiment of the submersible pump apparatus 20, as illustrated in FIG. 19.

Additionally, in the canned motor assembly 22, upon insertion of a lock pin or rod (not illustrated) into the external hole 192 (see also FIG. 17(*c*), the lock pin or rod proceeds into the plastic pump housing 64. As the lock pin or rod proceeds further into the plastic pump housing 64, the lock pin or rod is received by a slot 210 (see also FIGS. 17*a* and 17*b*) and then proceeds through an internal bore 212 (see also FIG. 3) in the motor shaft 29 and into a second slot 215 (see also FIGS. 17*a* and 17*b*) on the opposite side of the motor shaft 29. In the alternate embodiment with the motor assembly 124, the lock pin or rod is inserted the exact same way except that the lock pin or rod proceeds into the blind hole 168 (see FIG. 13) in the spline base 162 of the shaft extension 140. In this manner, the lock pin or rod prevents the motor shaft 29 (in the canned motor assembly 22) or the shaft extension 140 and motor shaft 150 (in the motor assembly 124) from rotating when the hex bolt 185, holding the motor shaft 29 or the shaft extension 140 to the motor shaft 150, is tightened. This tightening also tightens the propellers 76, the second propeller 84 (in the double stage pump 85), and propeller spacers 78 to the male spline 160 of the shaft extension 140.

Thus, there has been provided a unique new and improved submersible pump apparatus. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A pump assembly for use within a fluid comprising:

the pump assembly having a proximal end and a distal end and defining an opening between them;

a motor and further defining a motor shaft extending outwardly from the motor within the opening of the pump assembly;

a first propeller freely rotatable within the opening and having opposed ends, the first propeller providing a first propeller hub having a first plurality of blades extending outwardly from the first propeller hub, and a plurality of first notches situated inside the first propeller hub;

means for releaseably coupling the motor shaft to the first propeller and driving the first propeller;

a first intermediate flow straightener situated within the opening;

a second propeller freely rotatable within the opening, the second propeller providing a second propeller hub having a second plurality of blades extending outwardly from the second propeller hub, and a plurality of second notches situated inside the second propeller hub;

a propeller spacer situated between the first propeller and the second propeller; the propeller spacer having a proximal end facing the first propeller and a distal end facing the second propeller, a plurality of first tongues extending in the longitudinal direction away from the proximal end of the propeller spacer and outwardly toward the first propeller and releaseably received into the plurality of first notches in the first propeller, the propeller spacer situated on the opposite side of the first propeller from the motor, and a plurality of second tongues extending in the longitudinal direction away from the distal end of the propeller spacer and outwardly toward the second propeller and releaseably received into the plurality of second notches in the second propeller;

the first propeller, the propeller spacer, and the second propeller abutting one another in end to end axial alignment;

the first intermediate flow straightener positioned between the first propeller and the second propeller; and wherein, during operation, when the motor is engaged causing the motor shaft to rotate, the motor shaft drives the first propeller, the first propeller drives the propeller spacer, and the propeller spacer then drives the second propeller.

2. The pump assembly of claim 1 wherein the means for releaseably coupling the motor shaft to the first propeller and driving the first propeller is a key provided on the exterior of the motor shaft and the first propeller having a female spline and an adjacent at least one internal spline, the motor shaft being received into the female spline and the key being received into the at least one internal spline.

3. The pump assembly of claim 1 wherein the first intermediate flow straightener providing a first plurality of vanes with each of the first plurality of vanes having a curvilinear arc.

4. The pump assembly of claim 3 wherein the curvilinear arc is positioned at an initial angle relative to the fluid in the first turbulent state with the arc curving to a final angle relative to the fluid in the substantially first straight flow exiting out the first intermediate flow straightener.

5. The pump assembly of claim 4 wherein the final angle is substantially zero degrees as measured from the vertical.

6. The pump assembly of claim 5 wherein the second intermediate flow straightener is identical to the first intermediate flow straightener.

7. The pump assembly of claim 1 wherein the propeller spacer defining a circumference with each of the plurality of first tongues and each of the plurality of second tongues in alignment with the circumference; each of the plurality of first tongues having a radial line from the center of the circumference to the center of each of the plurality of first tongues; the plurality of second tongues having a second radial line from the center of the circumference to the center of each of the plurality of second tongues; and the radial line from the center of each of the plurality of first tongues oriented sixty degrees (60°) from the second radial line from the center of each of the plurality of second tongues.

8. The pump assembly of claim 1 wherein a pump housing is created by the interconnection of the first propeller housed within a primary shroud to the propeller spacer housed within the first intermediate flow straightener, and to the second propeller housed within a second shroud.

9. The pump assembly of claim 8 wherein the first propeller forcing the fluid to enter through the proximal end and into the opening of the pump assembly and causing the fluid to be in a first turbulent state, the first intermediate flow straightener forcing the fluid to change from the first turbulent state into a substantially first straight flow before engaging the second propeller, the second propeller forcing the fluid to continue through the opening toward the distal end causing the fluid to be in a second turbulent state; and the second intermediate flow straightener forcing the fluid to change from the second turbulent state into a substantially second straight flow prior to exiting out the distal end of the pump assembly.

10. The pump assembly of claim 1 wherein a second intermediate flow straightener situated within the opening.

* * * * *